US008748069B2

(12) United States Patent
Zhu et al.

(10) Patent No.: US 8,748,069 B2
(45) Date of Patent: Jun. 10, 2014

(54) ELECTROPHOTOGRAPHIC PHOTOCONDUCTOR AND METHOD FOR PRODUCING SAME

(75) Inventors: Fengqiang Zhu, Matsumoto (JP); Shinjiro Suzuki, Matsumoto (JP); Masaru Takeuchi, Matsumoto (JP); Quanqiu Zhang, Matsumoto (JP)

(73) Assignee: Fuji Electric Co., Ltd., Kawasaki-Shi (JP)

( * ) Notice: Subject to any disclaimer, the term of this patent is extended or adjusted under 35 U.S.C. 154(b) by 0 days.

(21) Appl. No.: 13/885,683

(22) PCT Filed: Dec. 9, 2010

(86) PCT No.: PCT/JP2010/072081

§ 371 (c)(1),
(2), (4) Date: Aug. 2, 2013

(87) PCT Pub. No.: WO2012/077206

PCT Pub. Date: Jun. 14, 2012

(65) Prior Publication Data

US 2013/0316278 A1 Nov. 28, 2013

(51) Int. Cl.
*G03G 5/04* (2006.01)
*G03G 5/05* (2006.01)
*G03G 5/047* (2006.01)

(52) U.S. Cl.
CPC ..... *G03G 5/0517* (2013.01); *G03G 5/047* (2013.01)
USPC ..... 430/58.05; 430/59.1; 430/127

(58) Field of Classification Search
CPC ..... G03G 5/0517; G03G 5/047
USPC ..... 430/58.05, 59.1, 127
See application file for complete search history.

(56) References Cited

U.S. PATENT DOCUMENTS

| | | | |
|---|---|---|---|
| 4,952,470 | A | 8/1990 | Tamaki et al. |
| 5,665,500 | A | 9/1997 | Suzuki |
| 6,030,733 | A | 2/2000 | Kami et al. |
| 6,210,848 | B1 | 4/2001 | Nagai et al. |
| 6,313,327 | B1 | 11/2001 | Seo et al. |
| 2002/0022193 | A1 | 2/2002 | Toriumi et al. |
| 2006/0068310 | A1 | 3/2006 | Nozomi et al. |
| 2006/0134541 | A1 | 6/2006 | Fujii et al. |
| 2010/0028791 | A1 | 2/2010 | Takaki et al. |

FOREIGN PATENT DOCUMENTS

| | | | |
|---|---|---|---|
| JP | S48-10055 | A | 2/1973 |
| JP | S57-122444 | A | 7/1982 |
| JP | S60-100537 | A | 6/1985 |
| JP | S63-18355 | A | 1/1988 |
| JP | H04-174859 | A | 6/1992 |

(Continued)

*Primary Examiner* — Peter Vajda
(74) *Attorney, Agent, or Firm* — Rabin & Berdo, P.C.

(57) ABSTRACT

Provided are an electrophotographic photoconductor that satisfies sufficient wear resistance as well as various characteristics as a photoconductor, and that is little affected by harmful gas or the temperature and humidity environment, and a method for producing such an electrophotographic photoconductor. The electrophotographic photoconductor has at least a photosensitive layer on a conductive substrate. The photosensitive layer contains a diadamantyl diester compound represented by Formula (I) (in Formula (I), $R^1$, $R^2$ and $R^3$ each independently represent a hydrogen atom, a halogen atom, a substituted or unsubstituted C1-C6 alkyl group, a substituted or unsubstituted C1-C6 alkoxyl group, a C6-C20 aryl group or a heterocyclic group; l, m and n each represent an integer from 1 to 4; U and W represent a single bond or a substituted or unsubstituted C1-C6 alkylene group; and V represents an OCO group or a COO group).

10 Claims, 3 Drawing Sheets

(I − 1)

(56) References Cited

FOREIGN PATENT DOCUMENTS

| | | | |
|---|---|---|---|
| JP | H06-75394 | A | 3/1994 |
| JP | H06-118678 | A | 4/1994 |
| JP | H06-161125 | A | 6/1994 |
| JP | H07-168381 | A | 7/1995 |
| JP | H08-272126 | A | 10/1996 |
| JP | H09-265177 | A | 10/1997 |
| JP | H11-288113 | A | 10/1999 |
| JP | 2001-013708 | A | 1/2001 |
| JP | 2001-039928 | A | 2/2001 |
| JP | 2001-072645 | A | 3/2001 |
| JP | 2002-055450 | A | 2/2002 |
| JP | 2002-268250 | A | 9/2002 |
| JP | 2002-287388 | A | 10/2002 |
| JP | 2003-306469 | A | 10/2003 |
| JP | 2004-199051 | A | 7/2004 |
| JP | 2004-206109 | A | 7/2004 |
| JP | 2004-226637 | A | 8/2004 |
| JP | 2007-279446 | A | 10/2007 |
| JP | 2008-116720 | A | 5/2008 |
| JP | 2008-129343 | A | 6/2008 |

ELECTROPHOTOGRAPHIC PHOTOCONDUCTOR AND METHOD FOR PRODUCING SAME

TECHNICAL FIELD

The present invention relates to an electrophotographic photoconductor (hereafter also referred to simply as "photoconductor") that is used in electrophotographic printers, copiers, fax machines and the like, and to a method for producing the photoconductor. In particular, the present invention relates to an electrophotographic photoconductor having superior printing durability and gas resistance, elicited through additive improvement, and to a method for producing the electrophotographic photoconductor.

BACKGROUND ART

The various functions that are required of electrophotographic photoconductors include, ordinarily, a function of holding surface charge, in the dark, a function of generating charge through reception of light, and a function of transporting charge likewise through reception of light. Such photoconductors include so-called single-layer-type photoconductors, having a single photosensitive layer, wherein these functions are combined in one layer, and so-called multilayer-type photoconductors having a photosensitive layer that is a stack of layers functionally separated into a layer that contributes mainly to charge generation, and a layer that contributes to holding surface charge, in the dark, and to charge transport during light reception.

For instance, the Carlson method is used in image formation by an electrophotographic method that utilizes such electrophotographic photoconductors. Image formation according to this scheme involves charging a photoconductor in the dark, forming an electrostatic image, such as text or pictures of an original, on the charged photoconductor surface, developing the formed electrostatic image by means of toner, and transferring and fixing the developed toner image onto a support such as paper. The photoconductor after toner image transfer has residual toner and charge removed therefrom and is re-used.

Materials used in the above-described electrophotographic photoconductor include inorganic photoconductive materials such as selenium, selenium alloys, zinc oxide, and cadmium sulfide, dispersed in a resin binder; organic photoconductive materials such as poly-N-vinyl carbazole, 9,10-anthracenediol polyester, pyrazoline, hydrazone, stilbene, butadiene, benzidine, phthalocyanine or bisazo compounds, dispersed in a resin binder, or materials resulting from vacuum vapor deposition or sublimation of the foregoing.

Electrophotographic printing devices are required to possess ever higher durability and sensitivity, and faster responses, to cope with, for instance, increases in the number of copies to be printed in a networked office, and with the rapid development of lightweight electrophotographic printing machines. These devices, moreover, are held to strict requirements in terms of exhibiting low impact from gases, such as ozone and NOx that are generated in the device, as well as little fluctuation in image characteristic arising from variations in the usage environment (room temperature, humidity).

At present, however, conventional photoconductors do not necessarily satisfy in full the characteristics that are required from them, and are still problematic as regards the points below.

For instance, wear resistance is bedeviled by the following problems. With the introduction of tandem development and other schemes, high-speed printing machines have gained popularity in recent years, both in printers and copiers for monochrome printing as well as in models for color printing. Color printing, in particular, requires high resolution, and the positional precision of images is thus a major concern among the required specifications. As the printed copies pile up, the surface of the photoconductor is abraded by friction against paper, rollers, blades and the like. When the degree of such wear is significant, it becomes difficult to print images that boast high resolution and high image positional precision. Various approaches have been adopted in order to enhance wear resistance, but cannot be said to be fully perfected yet.

Ozone is well known as one of the gases that are generated in these devices. Ozone is generated by chargers and roller chargers that elicit corona discharge. It is deemed that the organic substances that make up the photoconductor are oxidized, and the original structure of the substances breaks down when the photoconductor is exposed to the ozone that remains or is retained within the device, and the photoconductor characteristic are significantly impaired. Moreover, it is found that ozone oxidizes the nitrogen in air into NOx, and that this NOx alters the organic substances that make up the photoconductor.

It is deemed that characteristic deterioration elicited by such gases extends not only to the outermost layer of the photoconductor, but that adverse effects arise also when the gas flows into the interior of a photosensitive layer. It is found that the outermost layer itself of the photoconductor is scraped off, though the amount of scraping varies, on account of friction with the above-described various members. When a harmful gas flows into the interior of the photosensitive layer, the organic substances in the photosensitive layer may undergo structural breakdown. Suppressing the inflow of such harmful gas is thus an issue to be addressed. In tandem-type color electrophotographic devices that rely on a plurality of photoconductors, in particular, variation in color occur as a result of differences in the degree of influence of the gas, depending on, for instance, the position at which drums are disposed in the device. Such variations are deemed to constitute an impediment to forming adequate images. Therefore, it is found that characteristic deterioration caused by gas is a particularly important issue in tandem-type color electrophotographic devices.

For instance, Patent Document 1 and Patent Document 2 disclose the feature of using an antioxidant compound, such as a hindered phenol compound, or a phosphorus-based compound, a sulfur-based compound, an amine-based compound, a hindered amine-based compound or the like. Patent Document 3 proposes a technology that involves using a carbonyl compound, and Patent Document 4 proposes a technology that involves using a benzoate-based or salicylate-based compound. Techniques proposed in order to enhance gas resistance include using an additive such as biphenyl or the like and using a specific polycarbonate resin, in Patent Document 5; combining a specific amine compound with a polyarylate resin, in Patent Document 6; and combining a polyarylate resin and a compound having a specific absorbance, in Patent Document 7. However, these techniques fail to afford a photoconductor that exhibits sufficient gas resistance. Even if the photoconductor did exhibit satisfactory gas resistance, the technologies do not address the issue of enhancing the wear resistance of the photoconductor. Moreover, satisfactory results are not yet forthcoming as regards other characteristics (for instance, image memory and potential stability in durability printing).

Patent Document 8 discloses the feature of prescribing the oxygen permeability coefficient of a surface layer to be no greater than a predetermined value, under a combined condition whereby a charge transport layer has a specific charge mobility, so that, as a result, it becomes possible to curb the influence exerted on a photoconductor by the gas that is generated around a charger. Patent Document 9 indicates that wear resistance and gas resistance can be enhanced by prescribing the water vapor permeability of a photosensitive layer to be no greater than a predetermined value. In this technology, however, the desired effect cannot be achieved unless a specific polymer charge transport substance is used. Thus, the mobility, structure and so forth of the charge transport substance are restricted, and hence the technology failed to meet in full various requirements as regards electrical characteristics.

Patent Document 10 indicates that a single-layer-type electrophotographic photoconductor having excellent gas resistance can be provided by using a specific diester compound, having a melting point not higher than 40° C., in a photosensitive layer. In this case, however, the substance of low melting point that is added into the layer is in contact, for a prolonged time, with parts of the device main body or cartridge in which the photoconductor, having the substance added thereinto, is used, and hence the compound may become smeared into the other part with which the compound is in contact, giving rise to so-called bleeding, which translates into defects on the image. A sufficient effect failed to be elicited here as well.

Characteristic variations in photoconductors depending on the usage environment include, firstly, impairment of image characteristics in low-temperature, low-humidity environments. Ordinarily, the sensitivity characteristic and the like of the photoconductors drop apparently in low-temperature, low-humidity environments. As a result, worsened image quality becomes manifest in terms of lower image density and poorer gradation in halftone images. Image memory accompanying the worsening of the sensitivity characteristic may become likewise conspicuous. Image memory is an instance of image impairment wherein the image that is recorded in the form of a latent image, in a first drum rotation, is affected by the variation in potential in second and subsequent drum rotations, such that unwanted portions are printed, particularly during printing of halftone images. In particular, negative memory, where shading of a printing image is reversed, becomes often conspicuously observable in low-temperature, low-humidity environments.

Image characteristic deterioration in high-temperature, high-humidity environments is a further issue. In high-temperature, high-humidity environments, the moving speed of charge in a photosensitive layer is ordinarily greater than that at normal temperature and humidity. This gives rise to an excessive increase in print density, and defects such as small black dots (fogging) or the like to appear on white solid images. An excessive increase in print density translates into greater toner consumption, while the increased one-dot diameter may upset fine gradation. As regards image memory, a frequently encountered occurrence is positive memory wherein shading in a printing image remains reflected without changes, contrary to what is the case in low-temperature, low-humidity environments.

The underlying causes for characteristic deterioration depending on temperature and humidity conditions include, in many instances, moisture absorption and moisture release by the resin binder in the surface layer of the photosensitive layer, and by the charge generation material. Against this background, various materials have been studied, as in Patent Document 11 and Patent Document 12, where a specific compound is added to a charge generation layer, and, as in Patent Document 13, where a specific polycarbonate-based polymeric charge transport substance is used in a surface layer. However, no materials have been found as yet that succeed in fully satisfying the various characteristics involved in curbing the influence that temperature and humidity conditions exerts on photoconductors.

The technology disclosed in Patent Document 14 managed to solve the problem of characteristic deterioration derived from the abovementioned temperature and humidity conditions, but was not necessarily adequate as regards wear resistance. Patent Document 15, which discloses diallyl adamantanedicarboxylate that is used as a starting material of a resin that can be used as an optical material or electric material, failed to fully assess compounds having an adamantane structure as additive materials for photoconductors. Patent Document 16 discloses a photoresist composition that contains a compound having an adamantane structure, and Patent Document 17 discloses a resist composition that contains at least one type of a compound that has two or more adamantyl skeletons in the molecule. Patent Document 18 discloses carboxylic acid derivatives having an adamantane structure, and Patent Document 19 discloses a novel adamantane carboxylate compound. However, these documents failed to sufficiently assess the use of such compounds as additive materials for photoconductors. Patent Document 20 discloses an electrophotographic photoconductor that contains a polymer compound having a specific adamantane structure in a photosensitive layer, and Patent Document 21 discloses an electrophotographic photoconductor provided with a photosensitive layer that contains a specific adamantane-based compound. However, these photoconductors were likewise insufficient.

Patent Document 1: Japanese Patent Application Publication No. S57-122444
Patent Document 2: Japanese Patent Application Publication No. S63-18355
Patent Document 3: Japanese Patent Application Publication No. 2002-268250
Patent Document 4: Japanese Patent Application Publication No. 2002-287388
Patent Document 5: Japanese Patent Application Publication No. H6-75394
Patent Document 6: Japanese Patent Application Publication No. 2004-199051
Patent Document 7: Japanese Patent Application Publication No. 2004-206109
Patent Document 8: Japanese Patent Application Publication No. H08-272126
Patent Document 9: Japanese Patent Application Publication No. H11-288113
Patent Document 10: Japanese Patent Application Publication No. 2004-226637
Patent Document 11: Japanese Patent Application Publication No. H6-118678
Patent Document 12: Japanese Patent Application Publication No. H7-168381
Patent Document 13: Japanese Patent Application Publication No. 2001-13708
Patent Document 14: Japanese Patent Application Publication No. 2007-279446
Patent Document 15: Japanese Patent Application Publication No. S60-100537
Patent Document 16: Japanese Patent Application Publication No. H9-265177

Patent Document 17: Japanese Patent Application Publication No. 2002-55450

Patent Document 18: Japanese Patent Application Publication No. 2001-39928

Patent Document 19: Japanese Patent Application Publication No. 2003-306469

Patent Document 20: Japanese Patent Application Publication No. H4-174859

Patent Document 21: Japanese Patent Application Publication No. H6-161125

As described above, various conventional technologies have been proposed regarding improvement of photoconductors. However, the technologies disclosed in the patent documents above failed to sufficiently suppress adverse effects, on photoconductors, derived from harmful gas and the temperature and humidity environment, while satisfying sufficient wear resistance as well as various characteristics as a photoconductor. Further improvements were thus required.

DISCLOSURE OF THE INVENTION

It is an object of the present invention to provide an electrophotographic photoconductor that satisfies sufficient wear resistance as well as various characteristics as a photoconductor, and that is little affected by harmful gas or the temperature and humidity environment, and to provide a method for producing such an electrophotographic photoconductor.

As a result of diligent research focused on the structure of resin binders that are used in the various layers that make up a photoconductor, the inventors identified an underlying cause of the above problems in voids that arise, at the molecular level, upon formation of a film by the resin binder, and found that the above problems could be solved by incorporating a diadamantyl diester compound, having a specific structure, in the film, to exploit the action whereby these voids are filled by the diadamantyl diester compound.

At present, mainly polycarbonates, polyarylate resins and the like are used as the resins that are utilized in the surface layer of photoconductors. To form a photosensitive layer, various functional materials are dissolved in a solvent, and a base is coated, by dip coating or spray coating, with the resulting solution, to form a coating film. The resin binder forms herein a film in such a manner that the resin binder envelops the functional materials, but voids of non-negligible size occur in the film at the molecular level. If large, these voids may conceivably result in worse wear resistance in the photoconductor, and may impair electrical characteristics due to inflow and outflow of a low-molecular gas such as a gas or water vapor.

Therefore, it is deemed that filling the voids formed by the resin binder with molecules of appropriate size should make it possible to form a stronger film, to enhance wear resistance, and to suppress inflow and outflow of a low-molecular gas such as a harmful gas or water vapor, to afford as a result a photoconductor in which no electric or image characteristics are impaired on account of variations in the environment. The inventors arrived at the present invention as a result of the above studies.

Specifically, the electrophotographic photoconductor of the present invention is an electrophotographic photoconductor having at least a photosensitive layer on a conductive substrate, wherein the photosensitive layer contains a diadamantyl diester compound represented by Formula (I) below:

(I)

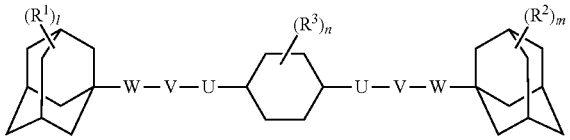

(in Formula (I), $R^1$, $R^2$ and $R^3$ each independently represent a hydrogen atom, a halogen atom, a substituted or unsubstituted C1-C6 alkyl group, a substituted or unsubstituted C1-C6 alkoxyl group, a C6-C20 aryl group or a heterocyclic group; l, m and n each represent an integer from 1 to 4; U and W represent a single bond or a substituted or unsubstituted C1-C6 alkylene group; and V represents an OCO group or a COO group, such that the substituent in cases where the foregoing are substituted denotes a halogen atom, an amino group, an imino group, a nitro group, a nitroso group or a nitrile group.)

The electrophotographic photoconductor of the present invention is also an electrophotographic photoconductor having at least an undercoat layer on a conductive substrate, wherein the undercoat layer contains a diadamantyl diester compound represented by Formula (I) above.

The electrophotographic photoconductor of the present invention is also an electrophotographic photoconductor having at least a charge generation layer on a conductive substrate, wherein the charge generation layer contains a diadamantyl diester compound represented by Formula (I) above.

The electrophotographic photoconductor of the present invention is also an electrophotographic photoconductor having at least a charge transport layer on a conductive substrate, wherein the charge transport layer contains a diadamantyl diester compound represented by Formula (I) above.

The electrophotographic photoconductor of the present invention is also an electrophotographic photoconductor having at least a surface protective layer on a conductive substrate, wherein the surface protective layer contains a diadamantyl diester compound represented by Formula (I) above.

In the present invention, the photosensitive layer can be of positive charging single-layer type or positive charging multilayer type. Preferably, the diadamantyl diester compound has a structure represented by Formula (I-1). The addition amount of the diadamantyl diester compound is set to 30 parts by mass or less with respect to 100 parts by mass of a resin binder that is comprised in the layer that contains the diadamantyl diester compound.

(I-1)

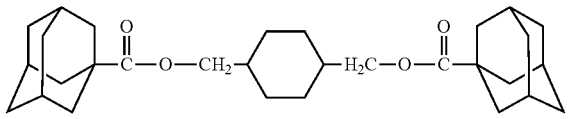

The method for producing an electrophotographic photoconductor of the present invention includes a step of forming a layer by applying a coating solution onto a conductive substrate, wherein the coating solution contains a diadamantyl diester compound represented by Formula (I) above.

By incorporating the above diadamantyl diester compound into the layer that constitutes the surface of the photoconductor, for instance the photosensitive layer or the surface protective layer, the present invention makes it possible to enhance wear resistance and to suppress intrusion of a harmful gas or water vapor into the interior of the photosensitive layer, regardless of the characteristics of the charge transport material and so forth that are used. A photoconductor can be realized thereby that exhibits little variation in electric and image characteristics caused by environmental variations. In a multilayer-type photoconductor, using the above diadamantyl diester compound in the charge generation layer or the undercoat layer makes it possible to suppress inflow and outflow of a harmful gas, water vapor and the like to/from a film; as a result, a photoconductor can be realized that exhibits little variation in electric and image characteristics caused by environmental variations. Therefore, the present invention allows enhancing the stability of electrical characteristics, independently from the organic substances that are used, and while unaffected by variations in the temperature and/or humidity of the usage environment, and allows realizing an electrophotographic photoconductor free of occurrence of image defects such as memory or the like. The above diadamantyl diester compound according to the present invention was not known in conventional art.

BEST MODE FOR CARRYING OUT THE INVENTION

Specific embodiments of the electrophotographic photoconductor according to the present invention will be explained in detail next with reference to accompanying drawings. The present invention is not limited in any way by the explanation set forth below.

Figure 1A:
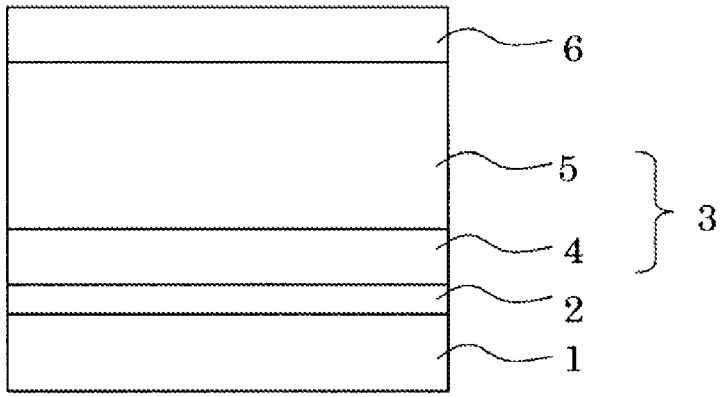
FIG. 1(*a*) is a schematic cross-sectional diagram illustrating an example of a negative charging functional separation multilayer-type electrophotographic photoconductor according to the present invention, FIG. 1(*b*) is a schematic cross-sectional diagram illustrating an example of a positive charging single-layer-type electrophotographic photoconductor according to the present invention, and FIG. 1(*c*) is a schematic cross-sectional diagram illustrating an example of a positive charging functional separation multilayer-type electrophotographic photoconductor according to the present invention.
Figure 1B:
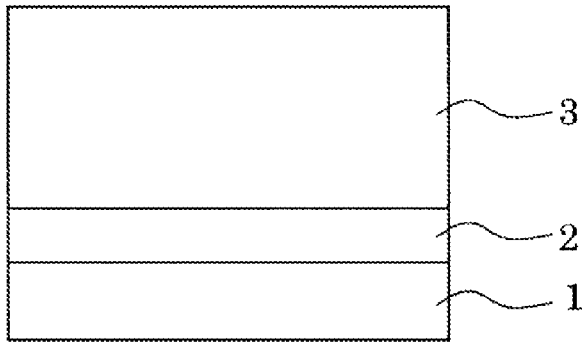
Figure 1C:
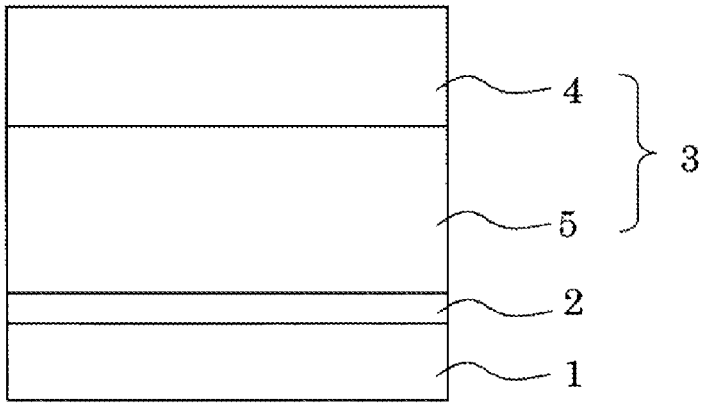

As described above, electrophotographic photoconductors can be classified, as functional separation-type multilayer-type photoconductors, into negative charging multilayer-type photoconductors and positive charging multilayer-type photoconductors, mainly single-layer-type photoconductors which are of positive charging type. FIG. 1 is a set of schematic cross-sectional diagrams illustrating electrophotographic photoconductors in an example of the present invention, wherein FIG. 1(*a*) illustrate an example of a functional separation multilayer-type electrophotographic photoconductor of negative charging type, FIG. 1(*b*) illustrates an example of a positive charging single-layer-type electrophotographic photoconductor, and FIG. 1(*c*) illustrates an example of a functional separation multilayer-type electrophotographic photoconductor of positive charging type. As illustrated in the figures, the negative charging multilayer-type photoconductor is obtained through sequential layering, onto a conductive substrate 1, of an undercoat layer 2, and a photosensitive layer 3 that comprises a charge generation layer 4 having a charge generation function and a charge transport layer 5 having a charge transport function. The positive charging single-layer-type photoconductor is obtained through sequential layering, on a conductive substrate 1, of an undercoat layer 2 and a single photosensitive layer 3 that combines two functions, i.e. a charge generation function and a charge transport function. The positive charging multilayer-type photoconductor is obtained through sequential layering, onto a conductive substrate 1, of an undercoat layer 2, and a photosensitive layer 3 that comprises a charge transport layer 5 having a charge transport function and a charge generation layer 4 having a charge generation function. The undercoat layer 2 may be provided as the case may require in the photoconductors of all types. Also, a surface protective layer 6 may be further provided on the photosensitive layer 3. In the present invention, "photosensitive layer" encompasses conceptually both a single-layer-type photosensitive layer, and a multilayer-type photosensitive layer having layered therein a charge generation layer and a charge transport layer.

A major feature of the present invention is that at least one of the layers that make up the photoconductor contains the diadamantyl diester compound represented by Formula (I) above. That is, the expected effect of the present invention can be achieved by incorporating such a compound in at least the photosensitive layer on the conductive substrate, in particular the photosensitive layer, in the case of a photoconductor of a configuration having a positive charging-type photosensitive layer. In a photoconductor of a configuration having at least an undercoat layer on a conductive substrate, the expected effect of the present invention can be achieved by incorporating such a compound in the undercoat layer. In a photoconductor of a configuration having at least a charge generation layer on a conductive substrate, the expected effect of the present invention can be achieved by incorporating such a compound in the charge generation layer. In a photoconductor of a configuration having at least a charge transport layer on a conductive substrate, the expected effect of the present invention can be achieved by incorporating such compound in the charge transport layer. In an electrophotographic photoconductor having at least a surface protective layer on a conductive substrate, the expected effect of the present invention can be achieved by incorporating such a compound in the surface protective layer.

In the photoconductors of all types above, the use amount of the diadamantyl diester compound in the photosensitive layer is preferably set to 30 parts by mass or less, more preferably 1 to 30 parts by mass, and particularly preferably 3 to 25 parts by mass, with respect to 100 parts by mass of resin binder comprised in the layer. A use amount of diadamantyl diester compound in excess of 30 parts by mass gives rise to precipitation, and is hence undesirable. The same applies to the use amount of the diadamantyl diester compound when present in layers other than the photosensitive layer.

Examples of the structure of the diadamantyl diester compound represented by Formula (I) according to the present invention are given below. However, the compounds used in the present invention are not limited to these compounds.

(I-1)

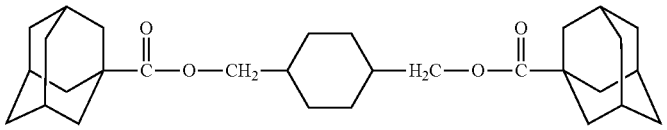

-continued
(I-2)
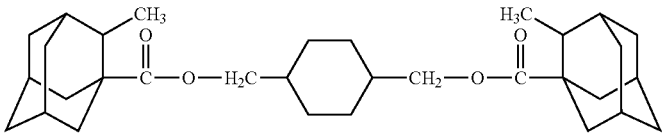
(I-3)
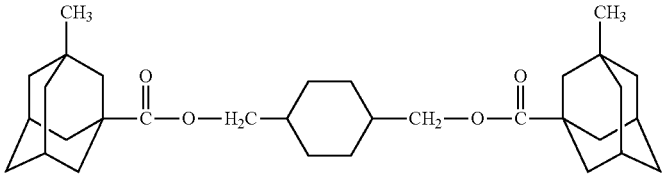
(I-4)
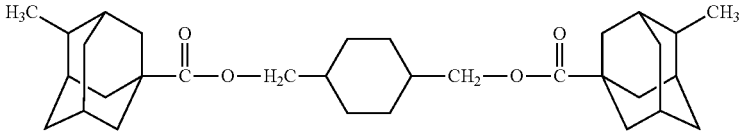
(I-5)
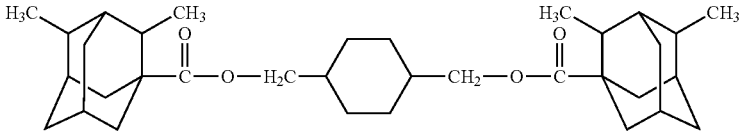
(I-6)
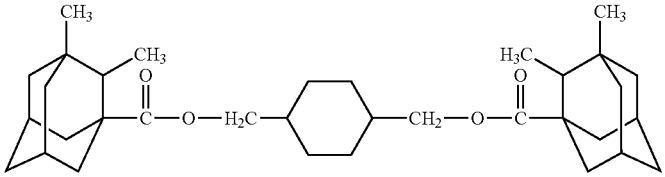
(I-7)
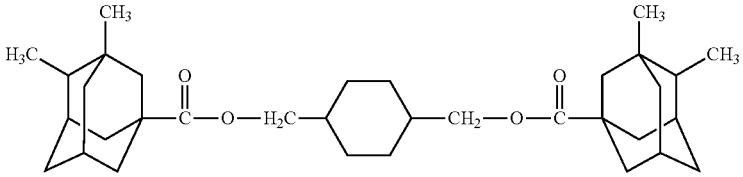
(I-8)
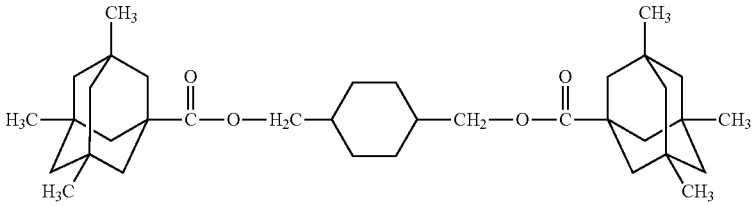
(I-9)
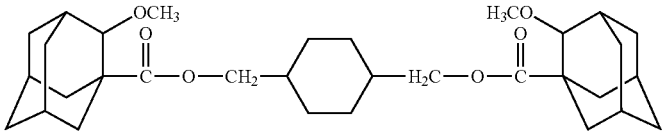
(I-10)
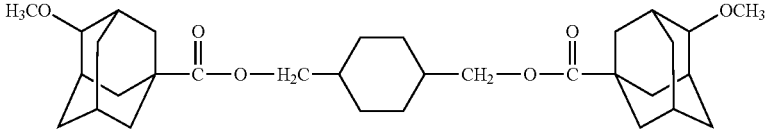

-continued (I-11)

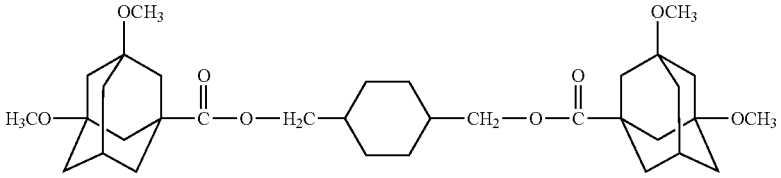

(I-12)

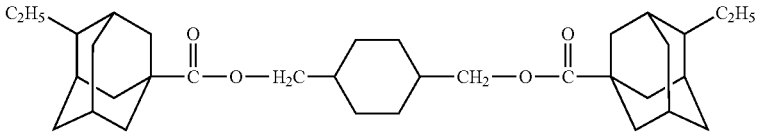

(I-13)

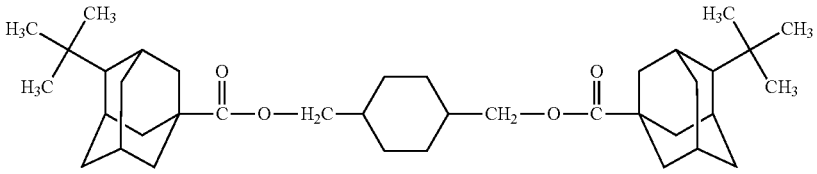

(I-14)

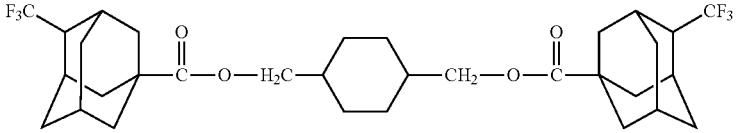

(I-15)

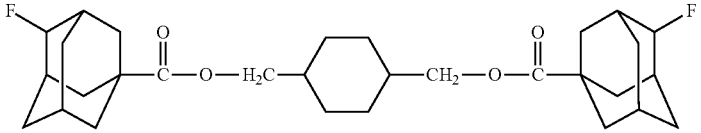

(I-16)

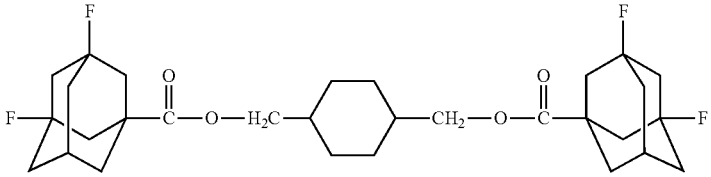

TABLE 1

| Compound | Group in Formula (I)*1 | | | | | |
|---|---|---|---|---|---|---|
| | U | V | W | $R^1$ | $R^2$ | $R^3$ |
| No. I-17 | Single bond | —C(=O)—O— | $CH_2$ | H | H | H |
| No. I-18 | Single bond | —C(=O)—O— | $CH_2$ | 2-Me | 2-Me | 2-Me |
| No. I-19 | Single bond | —C(=O)—O— | $CH_2$ | 3-Me | 3-Me | 2-Me |
| No. I-20 | Single bond | —C(=O)—O— | $CH_2$ | 4-Me | 4-Me | 2-Me |
| No. I-21 | Single bond | —C(=O)—O— | $CH_2$ | 4-OMe | 4-OMe | 2-Me |

TABLE 1-continued

| Compound | Group in Formula (I)*1 | | | | | |
|---|---|---|---|---|---|---|
| | U | V | W | $R^1$ | $R^2$ | $R^3$ |
| No. I-22 | Single bond | —C(=O)—O— | $CH_2$ | 4-Et | 4-Et | 2-Me |
| No. I-23 | Single bond | —C(=O)—O— | $CH_2$ | 4-tBu | 4-tBu | 2-Me |
| No. I-24 | Single bond | —C(=O)—O— | $CH_2$ | 4-$CF_3$ | 4-$CF_3$ | 2-Me |
| No. I-25 | $CH_2$ | —C(=O)—O— | $CH_2$ | H | H | H |
| No. I-26 | $CH_2$ | —C(=O)—O— | $CH_2$ | 2-Me | 2-Me | 2-Me |

TABLE 1-continued

| Compound | Group in Formula (I)*1 | | | | | |
|---|---|---|---|---|---|---|
| | U | V | W | $R^1$ | $R^2$ | $R^3$ |
| No. I-27 | $CH_2$ | —C(=O)—O— | $CH_2$ | 3-Me | 3-Me | 2-Me |
| No. I-28 | $CH_2$ | —C(=O)—O— | $CH_2$ | 4-Me | 4-Me | 2-Me |
| No. I-29 | $CH_2$ | —C(=O)—O— | $CH_2$ | 4-OMe | 4-OMe | 2-Me |
| No. I-30 | $CH_2$ | —C(=O)—O— | $CH_2$ | 4-Et | 4-Et | 2-Me |
| No. I-31 | $CH_2$ | —C(=O)—O— | $CH_2$ | 4-tBu | 4-tBu | 2-Me |
| No. I-32 | $CH_2$ | —C(=O)—O— | $CH_2$ | 4-$CF_3$ | 4-$CF_3$ | 2-Me |
| No. I-33 | Single bond | —C(=O)—O— | Single bond | H | H | H |
| No. I-34 | Single bond | —C(=O)—O— | Single bond | 2-Me | 2-Me | 2-Me |
| No. I-35 | Single bond | —C(=O)—O— | Single bond | 3-Me | 3-Me | 2-Me |
| No. I-36 | Single bond | —C(=O)—O— | Single bond | 4-Me | 4-Me | 2-Me |

TABLE 2

| Compound | Group in Formula (I)*1 | | | | | |
|---|---|---|---|---|---|---|
| | U | V | W | $R^1$ | $R^2$ | $R^3$ |
| No. I-37 | Single bond | —C(=O)—O— | Single bond | 4-OMe | 4-OMe | 2-Me |
| No. I-38 | Single bond | —C(=O)—O— | Single bond | 4-Et | 4-Et | 2-Me |
| No. I-39 | Single bond | —C(=O)—O— | Single bond | 4-tBu | 4-tBu | 2-Me |
| No. I-40 | Single bond | —C(=O)—O— | Single bond | 4-$CF_3$ | 4-$CF_3$ | 2-Me |
| No. I-41 | Single bond | —O—C(=O)— | Single bond | H | H | H |
| No. I-42 | Single bond | —O—C(=O)— | Single bond | 2-Me | 2-Me | 2-Me |
| No. I-43 | Single bond | —O—C(=O)— | Single bond | 3-Me | 3-Me | 2-Me |

TABLE 2-continued

| Compound | Group in Formula (I)*1 | | | | | |
|---|---|---|---|---|---|---|
| | U | V | W | $R^1$ | $R^2$ | $R^3$ |
| No. I-44 | Single bond | —O—C(=O)— | Single bond | 4-Me | 4-Me | 2-Me |
| No. I-45 | Single bond | —O—C(=O)— | Single bond | 4-OMe | 4-OMe | 2-Me |
| No. I-46 | Single bond | —O—C(=O)— | Single bond | 4-Et | 4-Et | 2-Me |
| No. I-47 | Single bond | —O—C(=O)— | Single bond | 4-tBu | 4-tBu | 2-Me |
| No. I-48 | Single bond | —O—C(=O)— | Single bond | 4-$CF_3$ | 4-$CF_3$ | 2-Me |
| No. I-49 | $CH_2$ | —O—C(=O)— | Single bond | H | H | H |
| No. I-50 | $CH_2$ | —O—C(=O)— | Single bond | 2-Me | 2-Me | 2-Me |
| No. I-51 | $CH_2$ | —O—C(=O)— | Single bond | 3-Me | 3-Me | 2-Me |
| No. I-52 | $CH_2$ | —O—C(=O)— | Single bond | 4-Me | 4-Me | 2-Me |
| No. I-53 | $CH_2$ | —O—C(=O)— | Single bond | 4-OMe | 4-OMe | 2-Me |
| No. I-54 | $CH_2$ | —O—C(=O)— | Single bond | 4-Et | 4-Et | 2-Me |
| No. I-55 | $CH_2$ | —O—C(=O)— | Single bond | 4-tBu | 4-tBu | 2-Me |
| No. I-56 | $CH_2$ | —O—C(=O)— | Single bond | 4-$CF_3$ | 4-$CF_3$ | 2-Me |

TABLE 3

| Compound | Group in Formula (I)*1 | | | | | |
|---|---|---|---|---|---|---|
| | U | V | W | $R^1$ | $R^2$ | $R^3$ |
| No. I-57 | Single bond | —O—C(=O)— | $CH_2$ | H | H | H |
| No. I-58 | Single bond | —O—C(=O)— | $CH_2$ | 2-Me | 2-Me | 2-Me |
| No. I-59 | Single bond | —O—C(=O)— | $CH_2$ | 3-Me | 3-Me | 2-Me |

TABLE 3-continued

| Compound | Group in Formula (I)*1 | | | | | |
|---|---|---|---|---|---|---|
| | U | V | W | $R^1$ | $R^2$ | $R^3$ |
| No. I-60 | Single bond | —O—C(=O)— | $CH_2$ | 4-Me | 4-Me | 2-Me |
| No. I-61 | Single bond | —O—C(=O)— | $CH_2$ | 4-OMe | 4-OMe | 2-Me |
| No. I-62 | Single bond | —O—C(=O)— | $CH_2$ | 4-Et | 4-Et | 2-Me |
| No. I-63 | Single bond | —O—C(=O)— | $CH_2$ | 4-tBu | 4-tBu | 2-Me |
| No. I-64 | Single bond | —O—C(=O)— | $CH_2$ | 4-$CF_3$ | 4-$CF_3$ | 2-Me |
| No. I-65 | $CH_2$ | —O—C(=O)— | $CH_2$ | H | H | H |
| No. I-66 | $CH_2$ | —O—C(=O)— | $CH_2$ | 2-Me | 2-Me | 2-Me |
| No. I-67 | $CH_2$ | —O—C(=O)— | $CH_2$ | 3-Me | 3-Me | 2-Me |
| No. I-68 | $CH_2$ | —O—C(=O)— | $CH_2$ | 4-Me | 4-Me | 2-Me |
| No. I-69 | $CH_2$ | —O—C(=O)— | $CH_2$ | 4-OMe | 4-OMe | 2-Me |
| No. I-70 | $CH_2$ | —O—C(=O)— | $CH_2$ | 4-Et | 4-Et | 2-Me |
| No. I-71 | $CH_2$ | —O—C(=O)— | $CH_2$ | 4-tBu | 4-tBu | 2-Me |
| No. I-72 | $CH_2$ | —O—C(=O)— | $CH_2$ | 4-$CF_3$ | 4-$CF_3$ | 2-Me |
| No. I-73 | $CH_2$ | —O—C(=O)— | $CH_2$ | 3-Ph | 3-Ph | H |
| No. I-74 | $CH_2$ | —O—C(=O)— | $CH_2$ | 3-p-tolyl | 3-p-tolyl | H |
| No. I-75 | $CH_2$ | —O—C(=O)— | $CH_2$ | 4-OMe | 4-OMe | 2-MeO |

*1In Formula (1), U, V and W are positioned symmetrically with respect to the cyclohexyl group. In the tables, V is bonded to U on the right, and to W on the left.

The conductive substrate 1 functions as one electrode of the photoconductor, and, at the same time, constitutes a support of the various layers that make up the photoconductor. The conductive substrate 1 may be of any shape, for instance, cylindrical, plate-like or film-like, and the material thereof may be a metal such as aluminum, stainless steel, nickel or the like, or a material such as glass, a resin or the like the surface whereof has undergone a conductive treatment.

The undercoat layer 2 comprises a layer having a resin as a main component, or a metal oxide coating film of alumite or the like, and is provided, as the case may require, in order to control the injectability of charge from the conductive substrate into the photosensitive layer, or for the purpose of, for instance, covering defects on a base surface, or enhancing adhesion between the photosensitive layer and an underlying member. Examples of the resin material that is used in the undercoat layer include, for instance, an insulating polymer such as casein, polyvinyl alcohol, polyamide, melamine, cellulose or the like, or a conductive polymer such as polythiophene, polypyrrole, and polyaniline or the like. These resins can be used singly or mixed with each other in appropriate combinations. The resins can contain a metal oxide such as titanium dioxide or zinc oxide.

(Negative Charging Multilayer-Type Photoconductor)

In the negative charging multilayer-type photoconductor, the charge generation layer 4 is formed in accordance with a method that involves, for instance, applying a coating solution in which particles of a charge generation material is dispersed in a resin binder, such that charge is generated is through reception of light. The injectability of the generated charge into the charge transport layer 5 is important, accompanied simultaneously with high charge generation efficiency. Preferably, electric-field dependence is low and injection is good also in low fields. Examples of the charge generation material include, for instance, phthalocyanine compounds such as X-type metal-free phthalocyanine, t-type metal-free phthalocyanine, α-type titanyl phthalocyanine, β-type titanyl phthalocyanine, Y-type titanyl phthalocyanine, γ-type titanyl phthalocyanine, amorphous-type titanyl phthalocyanine, ϵ-type copper phthalocyanine or the like; or pigments such as azo pigments, anthanthrone pigments, thiapyrylium pigments, perylene pigments, perinone pigments, squarylium pigments, quinacridone pigments and the like. The foregoing can be used singly or in appropriate combinations, and there can be selected an appropriate substance in accordance with the wavelength region of the exposure light source that is used for image formation.

It is sufficient for the charge generation layer 4 to have a charge generation function, and hence the thickness of the charge generation layer 4 is determined depending on the light absorption coefficient of the charge generation substance, and is ordinarily 1 μm or less, and preferably 0.5 μm or less. The charge generation layer has a charge generation material as a main constituent, and can be used having a charge transport material or the like added thereto. Examples of the resin binder that can be used include, for instance, appropriate combinations of polymers and copolymers such as polycarbonate resins, polyester resins, polyamide resins, polyurethane resins, vinyl chloride resins, vinyl acetate resins, phenoxy resins, polyvinyl acetal resins, polyvinyl butyral resins, polystyrene resins, polysulfone resins, diallyl phthalate resins, methacrylate resins and the like.

The charge transport layer 5 is mainly made up of the charge transport material and a resin binder. As the charge transport material there can be used various hydrazone compounds, styryl compounds, diamine compounds, butadiene compounds, indole compounds or the like, singly or mixed with each other in appropriate combinations. Examples of the resin binder include, for instance, polycarbonate resins of bisphenol A-type, bisphenol Z-type, bisphenol A-type-biphenyl copolymers, bisphenol Z-type-biphenyl copolymers, as well as polyarylate resins, polyphenylene resins, polyester resins, polyvinyl acetal resins, polyvinyl butyral resins, polyvinyl alcohol resins, vinyl chloride resins, vinyl acetate res ins, polyethylene resins, polypropylene resins, acrylic resins, polyurethane resins, epoxy resins, melamine resins, silicone resins, polyamide resins, polystyrene resins, polyacetal resins, polysulfone resin, as well as polymers and copolymers of methacrylic acid esters. The foregoing can be used singly or in appropriate compositions. Resins having dissimilar molecular weights may be used mixed with each other. The use amount of the charge transport material in the charge transport layer 5 ranges from 50 to 90 parts by mass, preferably 3 to 30 parts by mass with respect to 100 parts by mass of the resin binder. The content of the resin binder ranges preferably from 10 to 90 mass %, more preferably from 20 to 80 mass % with respect to the solids content of charge transport layer 5.

Examples of the charge transport material that is used in the charge transport layer 5 include those set forth below. However, the present invention is not limited in any way to these examples.

II-1

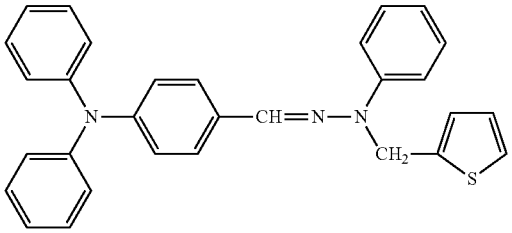

II-2

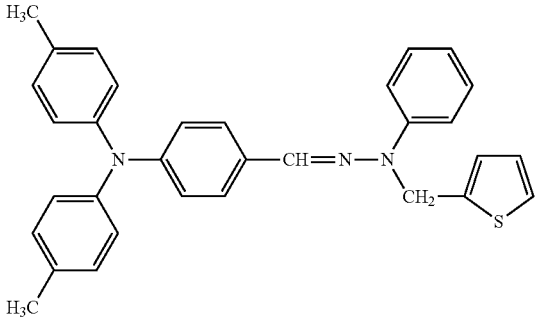

II-3

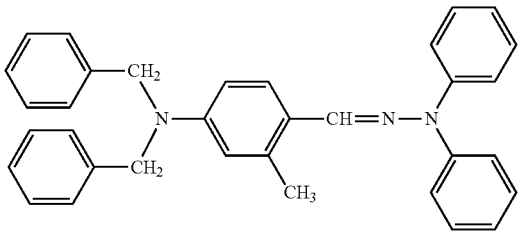

II-4

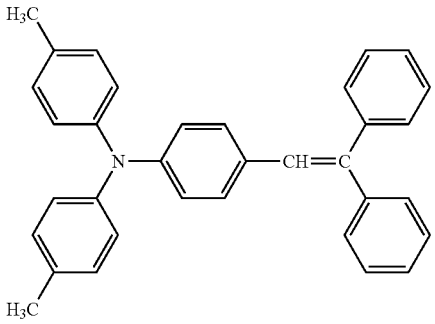

II-5

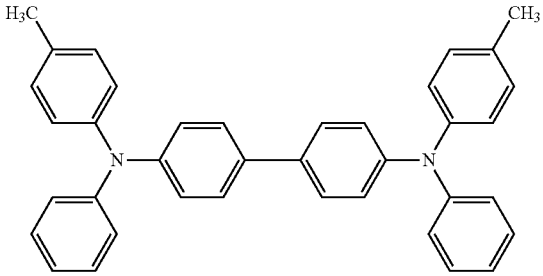

II-6

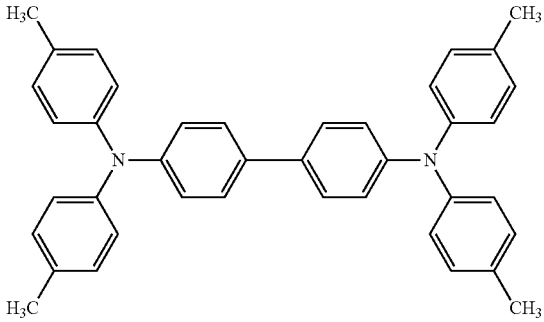

II-7

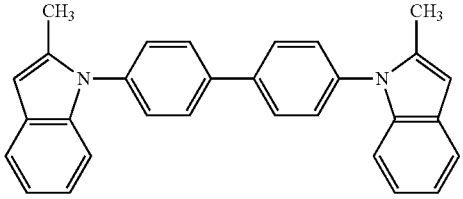

II-8

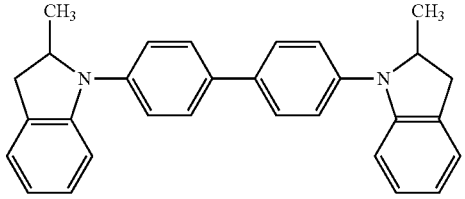

-continued
II-9
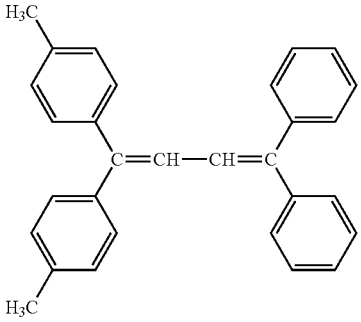
II-10
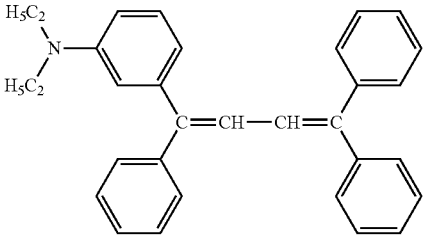
II-11
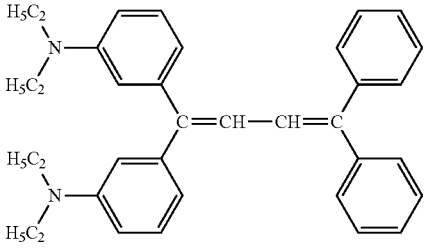
II-12
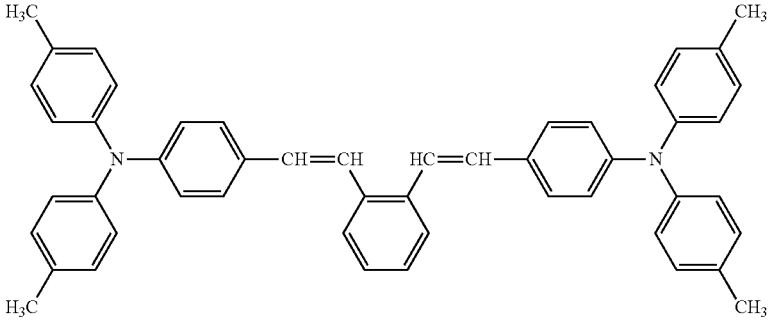
II-13
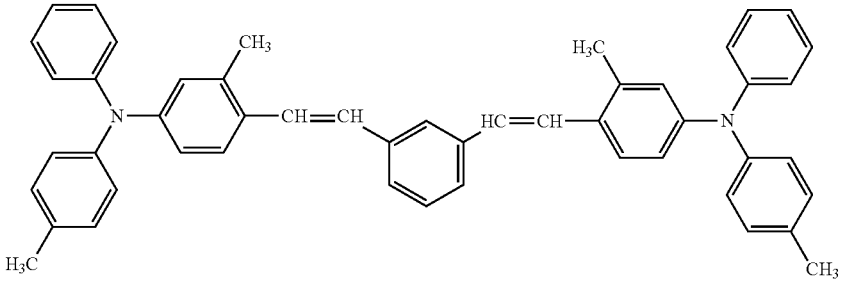
II-14
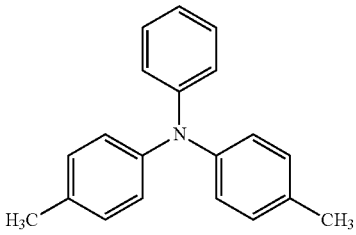

-continued

II-15

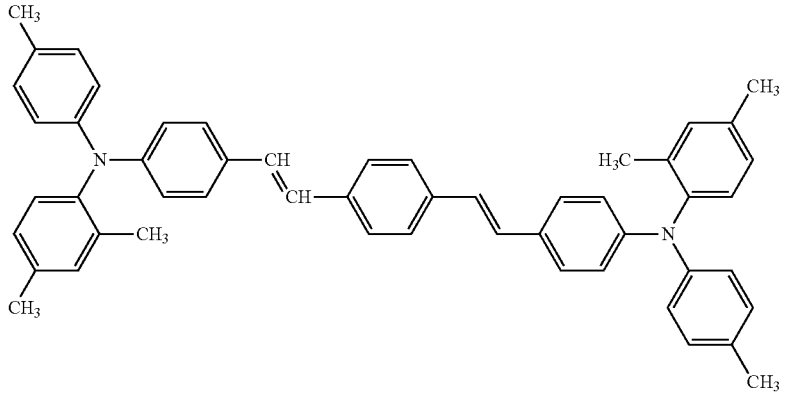

II-16

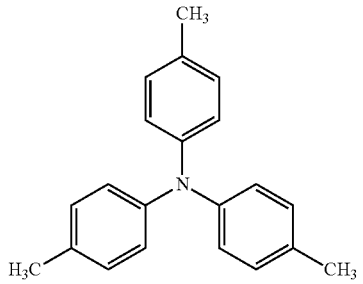

The thickness of the charge transport layer 5 ranges preferably from 3 to 50 μm, more preferably from 15 to 40 μm, in order to maintain an effective surface potential in practice.

(Single-Layer-Type Photoconductor)

In the case of a single layer-type, the photosensitive layer 3 of the present invention comprises mainly a charge generation material, a hole transport material, an electron transport material (acceptor compound) and a resin binder. As the charge generation material in such a case there can be used, for instance, phthalocyanine pigments, azo pigments, anthanthrone pigments, perylene pigments, perinone pigments, polycyclic quinone pigments, squarylium pigments, thiapyrylium pigments, quinacridone pigments or the like. These charge generation materials can be used singly or in combinations of two or more types. In particular, the electrophotographic photoconductor of the present invention is preferably a disazo pigment or a trisazo pigment or the like, from among azo pigments; N,N'-bis(3,5-dimethylphenyl)-3,4:9,10-perylene-bis(carboximide), as a perylene pigment; and metal-free phthalocyanine, copper phthalocyanine or titanyl phthalocyanine, as a phthalocyanine-based pigment. Pronounced effects of improving sensitivity, durability and image quality are elicited when using X-type metal-free phthalocyanine, τ-type metal-free phthalocyanine, ϵ-type copper phthalocyanine, α-type titanyl phthalocyanine, β-type titanyl phthalocyanine, Y-type titanyl phthalocyanine, amorphous-type titanyl phthalocyanine, or the titanyl phthalocyanine exhibiting a maximum peak at a Bragg angle 2θ of 9.6° in a CuKα X-ray diffraction spectrum as set forth in Japanese Patent Application Publication No. H8-209023, U.S. Pat. No. 5,736,282 (Specification) and U.S. Pat. No. 5,874,570 (Specification). The content of the charge generation material is preferably 0.1 to 20 mass %, more preferably 0.5 to 10 mass %, with respect to the solids content of the single-layer-type photosensitive layer 3.

As the hole transport material there can be used, for instance, hydrazone compounds, pyrazoline compounds, pyrazolone compounds, oxadiazole compounds, oxazole compounds, arylamine compounds, benzidine compounds, stilbene compounds, styryl compounds, poly-N-vinyl carbazole, polysilane or the like. The hole transport material can be used singly or in combinations of two or more types. Preferably, the hole transport material used in the present invention has excellent transportability of holes that are generated upon irradiation, and in addition, affords a good combination with the charge generation material. The content of the hole generation material is preferably 3 to 80 mass %, more preferably 5 to 60 mass %, with respect to the solids content of the single-layer-type photosensitive layer 3.

Examples of the electron transport material (acceptor compound), include, for instance, succinic anhydride, maleic anhydride, dibromo succinic anhydride, phthalic anhydride, 3-nitrophthalic anhydride, 4-nitrophthalic anhydride, pyromellitic anhydride, pyromellitic acid, trimellitic acid, trimellitic anhydride, phthalimide, 4-nitrophthalimide, tetracyanoethylene, tetracyanoquinodimethane, chloranil, bromanil, o-nitrobenzoic acid, malononitrile, trinitrofluorenone, trinitrothioxanthone, dinitrobenzene, dinitroanthracene, dinitroacridine, nitroanthraquinone, dinitroanthraquinone, thiopyran compounds, quinone compounds, benzoquinone compounds, diphenoquinone compounds, naphthoquinone compounds, anthraquinone compounds, stilbenequinone compounds, azoquinone compounds and the like. The electron transport material can be used singly or in combinations of two or more types. The content of the electron transport material is preferably 1 to 50 mass %, more preferably 5 to 40 mass %, with respect to the solids content of the single-layer-type photosensitive layer 3.

Examples of the resin binder that can be used in the single-layer-type photosensitive layer 3 include, for instance, polycarbonate resins of bisphenol A-type, bisphenol Z-type, bisphenol A-type-biphenyl copolymers, bisphenol Z-type-biphenyl copolymers, as well as polyphenylene resins, polyester resins, polyvinyl acetal resins, polyvinyl butyral resins, polyvinyl alcohol resins, vinyl chloride resins, vinyl acetate resins, polyethylene resins, polypropylene resins, acrylic resins, polyurethane resins, epoxy resins, melamine resin, silicone resins, polyamide resins, polystyrene resins, polyacetal resins, polyarylate resins, polysulfone resins, as well as polymers and copolymers of methacrylic acid esters. Resins having dissimilar molecular weights may be used mixed with each other.

The content of the resin binder ranges preferably from 10 to 90 mass %, more preferably from 20 to 80 mass % with respect to the solids content of the single-layer-type photosensitive layer 3.

The thickness of the single-layer-type photosensitive layer 3 ranges preferably from 3 to 100 μm, more preferably from 5 to 40 μm, in order to maintain an effective surface potential in practice.

(Positive Charging Multilayer-Type Photoconductor)

In the positive charging multilayer-type photoconductor, the charge transport layer 5 is mainly made up of a charge transport material and a resin binder. The charge transport material and the resin binder are not particularly limited, and there can be used materials identical to those exemplified regarding the charge transport layer 5 in the negative charging multilayer-type photoconductor. The content of the materials and the thickness of the charge transport layer 5 can be identical to those of the negative charging multilayer-type photoconductor.

The charge generation layer 4 that is provided on the charge transport layer 5 comprises mainly a charge generation material, a hole transport material, an electron transport material (acceptor compound) and a resin binder. The same materials as exemplified for the single-layer-type photosensitive layer 3 in the single-layer-type photoconductor can be used herein as the charge generation material, the hole transport material, the electron transport material and the resin binder. The content of the materials and the thickness of the charge generation layer 4 can be identical to those of the single-layer-type photosensitive layer 3 of the single-layer-type photoconductor.

In the present invention, various additives can be used, as the case may require, in the undercoat layer 2, the photosensitive layer 3, the charge generation layer 4 and the charge transport layer 5, for the purpose of, for instance, enhancing sensitivity, reducing residual potential, and affording high durability in terms of environmental resistance, stability towards harmful light, and abrasion resistance. As the additive there can be used, other than the compound represented by Formula (I) of the present invention, also compounds such as succinic anhydride, maleic anhydride, dibrome succinic anhydride, pyromellitic anhydride, pyromellitic acid, trimellitic acid, trimellitic anhydride, phthalimide, 4-nitro phthalimide, tetracyanoethylene, tetracyanoquinodimethane, chloranil, bromanil, o-nitro benzoic acid, trinitrofluorenone or the like. Anti-degradation agents, such as antioxidants and light stabilizers, can also be added. Compounds used for such purposes include, for instance, chromanol derivatives such as tocopherol, as well as ether compounds, ester compounds, polyarylalkane compounds, hydroquinone derivatives, diether compounds, benzophenone derivatives, benzotriazole derivatives, thioether compounds, phenylenediamine derivatives, phosphonates, phosphites, phenolic compounds, hindered phenol compounds, linear amine compounds, cyclic amine compounds or hindered amine compounds, but are not limited to the foregoing.

A leveling agent such as a silicone oil or fluorinated oil can be incorporated into the photosensitive layer for the purpose of enhancing leveling in the formed film and imparting further lubricity. With the purpose of, for instance, adjusting film hardness, lowering the coefficient of friction, and imparting lubricity, there may be incorporated microparticles of a metal oxide such as silicon oxide (silica), titanium oxide, zinc oxide, calcium oxide, aluminum oxide (alumina), zirconium oxide or the like; of a metal sulfide such as barium sulfate, calcium sulfate or the like; or of a metal nitride such as silicon nitride, aluminum nitride or the like; or fluororesin particles of tetrafluoroethylene resins or fluorine-based comb-type graft polymerization resins. Other known additives may be incorporated, as the case may require, so long as electrophotographic characteristics are not significantly impaired thereby.

In the present invention, the surface protective layer 6 can be further provided, as the case may require, on the photosensitive layer surface, in order to further enhance environmental resistance and mechanical strength. Preferably, the surface protective layer 6 is made up of a material having excellent environmental resistance and durability towards mechanical stress, and has the ability of transmitting, with the lowest loss possible, light to which the charge generation layer is sensitive.

The surface protective layer 6 comprises a layer having a resin binder as a main component, and/or an inorganic thin film such as amorphous carbon. With the purpose of, for instance, enhancing conductivity, lowering the coefficient of friction, and imparting lubricity, the resin binder may contain a metal oxide such as silicon oxide (silica), titanium oxide, zinc oxide, calcium oxide, aluminum oxide (alumina), zirconium oxide or the like; a metal sulfate such as barium sulfate, calcium sulfate or the like; or a metal nitride such as silicon nitride, aluminum nitride or the like; microparticles of a metal oxide, or fluororesin particles of tetrafluoroethylene resins, or fluorine-based comb-type graft polymerization resins.

The compound represented by Formula (I) above according to the present invention can be used in the surface protective layer 6 in order to enhance wear resistance and curtail inflow and outflow of gas and vapor. The charge transport substance and/or electron acceptor substance used in the photosensitive layer can be incorporated in order to impart charge transportability. A leveling agent such as a silicone oil or a fluorinated oil can be incorporated into the photosensitive layer for the purpose of enhancing the leveling of the formed film and imparting further lubricity.

The thickness of the surface protective layer 6 itself depends on the blending composition of the surface protective layer, and can be arbitrarily set, so long as no adverse effects are elicited thereby, for instance increased residual potential upon repeated and continued use.

The diadamantyl diester compound represented by Formula (I) above is incorporated into the coating solution for forming the various layers that make up the photoconductor of the present invention, during production of the photoconductor. The coating solution can be used in various coating methods, for instance dip coating, spray coating or the like, and is not limited to any coating method.

(Electrophotographic Device)

The electrophotographic photoconductor of the present invention affords the expected effect by being used in various machine processes. Specifically, sufficient effects can be elicited in a charging process, for instance, a contact charging scheme relying on rollers or brushes, a contact-less charging scheme relying on a corotron, scorotron or the like, and in the development process, for instance contact development and non-contact development schemes that rely on non-magnetic single-component development, magnetic single-component development, and two-component development.

Figure 2:
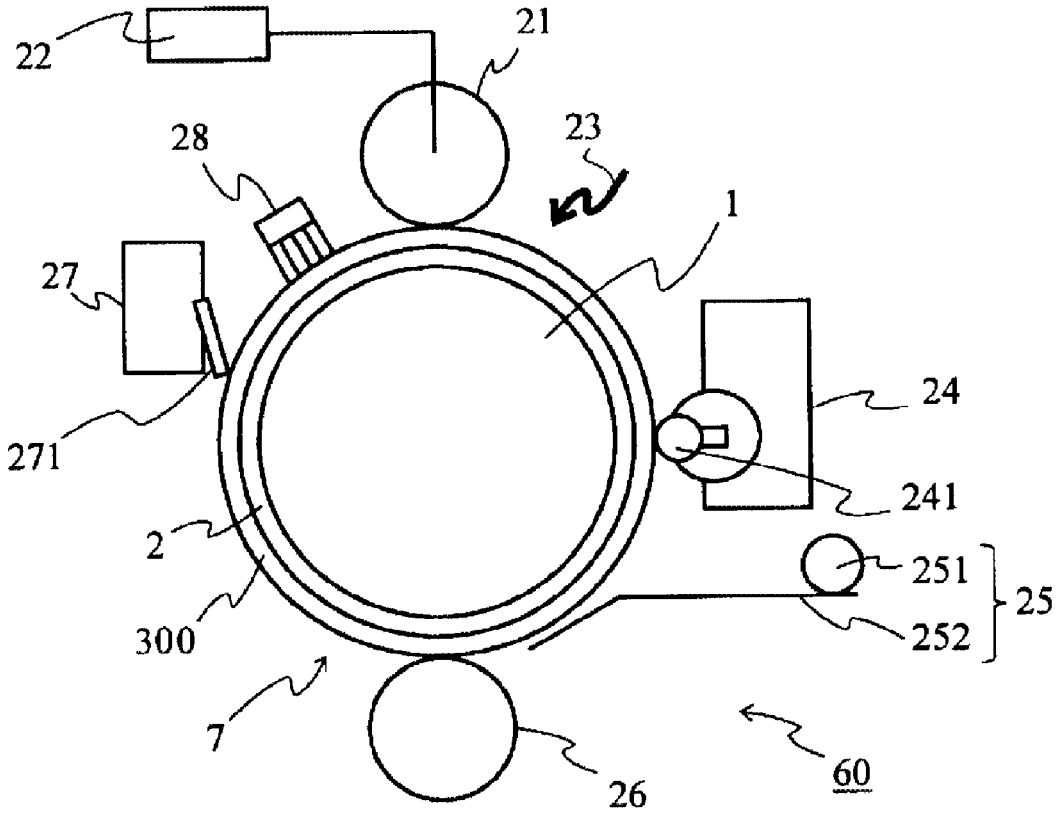
FIG. 2 is a schematic configuration diagram illustrating an example of an electrophotographic device according to the present invention.

As an example, FIG. 2 illustrates a schematic configuration diagram of an electrophotographic device according to the present invention. An electrophotographic photoconductor 7 of the present invention, comprising a conductive substrate 1, an undercoat layer 2 that covers the outer peripheral face of the conductive substrate 1, and a photosensitive layer 300, is installed in the electrophotographic device 60 of the figure. The electrophotographic device 60 is further provided with: a roller charging member 21 that is disposed on the outer peripheral edge of the photoconductor 7; a high voltage power source 22 that supplies applied voltage to the roller charging member 21; an image exposure member 23; a developing device 24 comprising a developing roller 241; a paper feed member 25 comprising a paper feed roller 251 and a paper feed guide 252; a transfer charger (of direct charging type) 26; a cleaning device 27 comprising a cleaning blade 271; and a charge-removing member 28. The electrophotographic device 60 can be used as a color printer.

EXAMPLES

Examples of the present invention are explained in detail below.

Synthesis Example

Under a stream of Ar, 10.0 g of 1,4-cyclohexanedimethanol and 15.8 g of pyridine were dissolved in 150 ml of anhydrous tetrahydrofuran (THF) in a 1000-ml three-necked flask, and a solution resulting from dissolving 25.0 g of 1-adamantane carboxylic acid in 140 ml of anhydrous THF was dripped thereinto, at room temperature, using a dropping funnel. After dripping, the reaction was left to proceed for 8 hours at 50° C., followed by cooling to room temperature. Thereafter, the reaction solution was washed thrice with 300 ml of ion-exchanged water and was purified by being re-crystallized thrice with THF, to yield as a result 29.5 g of the target compound represented by Formula (I-1). (NMR analysis results (structural isomers: 73/27)).

Figure 3:
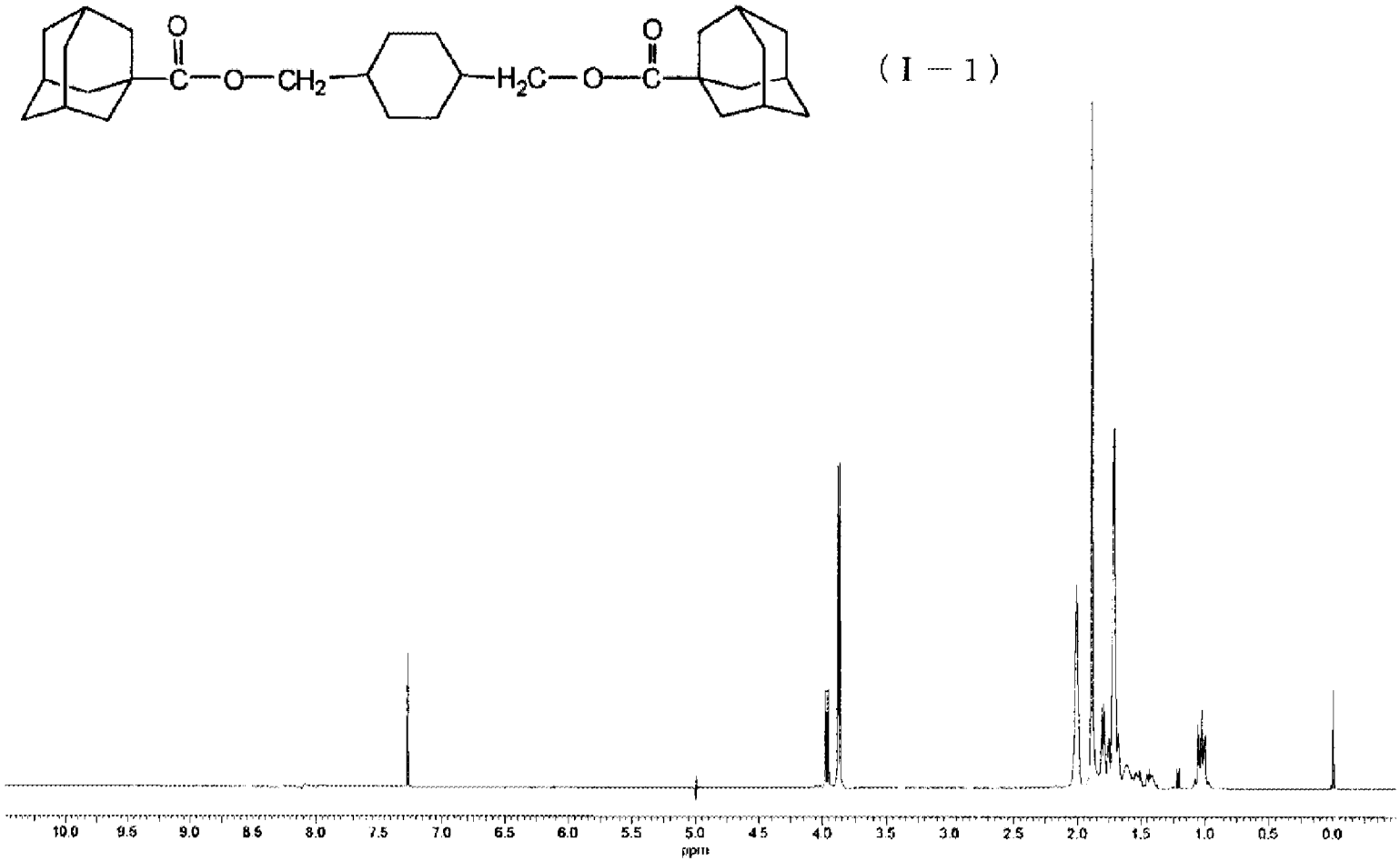
FIG. 3 illustrates an NMR spectrum of a compound represented by Formula (I-1).

The structure of the obtained compound was checked based on mechanical analysis such as NMR spectrometry, mass spectrometry and infrared spectrometry. FIG. 3 illustrates the NMR spectrum of the obtained compound of Formula (I-1).

Production Example of a Negative Charging Multilayer-Type Photoconductor

Example 1

The outer periphery of an aluminum cylinder having an outer diameter ϕ of 30 mm, as a conductive substrate, was dip-coated in an coating solution prepared by dissolving and dispersing, in 90 parts by mass of methanol, 5 parts by mass of alcohol-soluble nylon (trade name "Amilan CM8000", by TORAY INDUSTRIES, INC.) and 5 parts by mass of titanium oxide microparticles having undergone an aminosilane treatment, followed by 30 minutes of drying at a temperature of 100° C., to form thereby an undercoat layer having a thickness of about 2 μm.

The undercoat layer was dip-coated with a coating solution prepared by dispersing 1.5 parts by mass of the Y-type titanyl phthalocyanine disclosed in Japanese Patent Application Publication No. S64-17066 or U.S. Pat. No. 4,898,799 (Specification), as a charge generation material, 1.5 parts by mass of polyvinyl butyral (trade name "S-LEC B BX-1", by Sekisui Chemical Co., Ltd.), as a resin binder, and 60 parts by mass of an equal mixture of dichloromethane and dichloroethane, for 1 hour in a sand-mill disperser, followed by 30 minutes of drying at a temperature of 80° C., to form thereby a charge generation layer having a thickness of about 0.3 μm.

On the charge generation layer there was formed a film through application of a coating solution that was prepared by dissolving 100 parts by mass of the compound represented by structural formula (II-1), as a charge transport material, 100 parts by mass of a polycarbonate resin (trade name "Panlite TS-2050", by TEIJIN CHEMICALS LTD.), as a resin binder, in 900 parts by mass of dichloromethane, with subsequent addition of 0.1 parts by mass of a silicone oil (KP-340, by Shin-Etsu Polymer Co., Ltd.), and further addition of 10 parts by mass of the compound represented by Formula (I-1) above. This was followed by 60 minutes drying at a temperature of 90° C., to form thereby a charge transport layer having a thickness of about 25 μm. An electrophotographic photoconductor was thus produced.

Examples 2 to 75

Electrophotographic photoconductors were produced in the same way as in Example 1, but by changing the compound represented by Formula (I-1) above to the compounds represented by Formulas (I-2) to (I-75) above.

Example 76

An electrophotographic photoconductor was produced in the same way as in Example 1, but using herein 1.0 part by mass as the addition amount of the compound represented by Formula (I-1) above.

Example 77

An electrophotographic photoconductor was produced in the same way as in Example 1, but using herein 3.0 parts by mass as the addition amount of the compound represented by Formula (I-1) above.

Example 78

An electrophotographic photoconductor was produced in the same way as in Example 1, but using herein 6.0 parts by mass as the addition amount of the compound represented by Formula (I-1) above.

Example 79

An electrophotographic photoconductor was produced in the same way as in Example 1, except that herein the compound represented by Formula (I-1) above was not added to the charge transport layer, but was added, in an amount of 3.0 parts by mass, to the undercoat layer.

Example 80

An electrophotographic photoconductor was produced in the same way as in Example 1, except that herein the compound represented by Formula (I-1) above was not added to the charge transport layer, but was added, in an amount of 3.0 parts by mass, to the charge generation layer.

Example 81

A charge transport layer was formed in the same way as in Example 1, except that herein the compound represented by Formula (I-1) above and the silicone oil were excluded from the coating solution for charge transport layer that were used in Example 1, and the charge transport layer was formed to a thickness of 20 μm. On top of the charge transport layer a film was formed thereafter through application of a coating solution that was prepared by dissolving 80 parts by mass of the compound represented by structural formula (II-1) above, as a charge transport material, and 120 parts by mass of a polycarbonate resin (PCZ-500, by MITSUBISHI GAS CHEMICAL COMPANY, INC.), as a resin binder, in 900 parts by mass of dichloromethane, with subsequent addition of 0.1 parts by mass of a silicone oil (KP-340, by Shin-Etsu Polymer Co., Ltd.), and further addition of 12 parts by mass of the compound represented by Formula (I-1) above. This was followed by 60 minutes drying at a temperature of 90° C., to form thereby a surface protective layer having a thickness of about 10 μm. An electrophotographic photoconductor was thus produced.

Example 82

An electrophotographic photoconductor was produced in the same way as in Example 1, except that herein the compound represented by Formula (I-1) above was not added to the charge transport layer, but was added, in an amount of 3.0 parts by mass, to the undercoat layer, and in an amount of 1.0 part by mass to the charge generation layer.

Example 83

An electrophotographic photoconductor was produced in the same way as in Example 1, but herein 3.0 parts by mass of the compound represented by Formula (I-1) above were added to the undercoat layer, and the addition amount of the compound represented by Formula (I-1) above in the charge transport layer was set to 3.0 parts by mass.

Example 84

An electrophotographic photoconductor was produced in the same way as in Example 1, but herein 3.0 parts by mass of the compound represented by Formula (I-1) above were added to the charge generation layer, and the addition amount of the compound represented by Formula (I-1) above in the charge transport layer was set to 3.0 parts by mass.

Example 85

An electrophotographic photoconductor was produced in the same way as in Example 1, but herein 3.0 parts by mass of the compound represented by Formula (I-1) above were added to the undercoat layer, and 1.0 part by mass to the charge generation layer, and the addition amount of the compound represented by Formula (I-1) above in the charge transport layer was set to 3.0 parts by mass.

Example 86

An electrophotographic photoconductor was produced in the same way as in Example 1, but herein the charge generation material used in Example 1 was changed to the α-type titanyl phthalocyanine disclosed in Japanese Patent Application Publication No. S61-217050 and U.S. Pat. No. 4,728,592 (Specification).

Example 87

An electrophotographic photoconductor was produced in the same way as in Example 1 but herein the charge generation material used in Example 1 was changed to X-type metal-free phthalocyanine (Fastogen Blue 8120B, by Dainippon Ink & Chemicals Inc.).

Comparative Example 1

An electrophotographic photoconductor was produced in the same way as in Example 1, except that herein the compound represented by Formula (I-1) above was not added to the charge transport layer.

Comparative Example 2

An electrophotographic photoconductor was produced in the same way as in Example 1, except that herein the compound represented by Formula (I-1) above was not added to the charge transport layer, and the amount of resin binder used in the charge transport layer was increased to 110 parts by mass.

Comparative Example 3

An electrophotographic photoconductor was produced in the same way as in Example 1 but herein, instead of not adding the compound represented by Formula (I-1) above to the charge transport layer, there were added 10 parts by mass of dioctyl phthalate (by Wako Pure Chemical Industries, Ltd.).

Comparative Example 4

An electrophotographic photoconductor was produced in the same way as in Example 83, except that herein the compound represented by Formula (I-1) above was not used.

Comparative Example 5

An electrophotographic photoconductor was produced in the same way as in Example 84, except that herein the compound represented by Formula (I-1) above was not used.

The photoconductors produced in Examples 1 to 87 and Comparative Examples 1 to 5 were set in a LJ4250, by Hewlett-Packard Company, and were evaluated in accordance with the below-described method. Specifically, the photoconductor surface was charged to −650 V through corona discharge in the dark, and thereafter the surface potential V0 immediately after charging was measured. Next, each photoconductor was left to stand in the dark for 5 seconds, the surface potential V5 was measured, and a potential holding rate Vk5(%) after 5 seconds from charging was worked out in accordance with the expression below.

$$Vk5=V5/V0\times100$$

With a halogen lamp as a light source, exposure light resolved to 780 nm using a filter was irradiated next onto the photoconductor for 5 seconds from the point in time at which the surface potential reached −600 V; the exposure amount required for optical attenuation such that the surface potential reached −300 V was worked out as E1/2 ($\mu Jcm^{-2}$), and the exposure amount required for optical attenuation to −50 V was worked out as sensitivity E50 ($\mu Jcm^{-2}$).

The photoconductors produced in Examples 1 to 87 and Comparative Examples 1 to 5 were arranged in an ozone exposure device in which a photoconductor could be exposed to an ozone atmosphere, and ozone exposure was performed at 100 ppm for 2 hours. Thereafter, the abovementioned potential holding rate was measured again, and the degree of change of the holding rate Vk5 before and after ozone exposure was worked out, to yield a rate of change of ozone exposure holding (ΔVk5) as a percentage. The rate of change of ozone exposure holding is worked out in accordance with the expression below, where $Vk5_1$ denotes the holding rate before ozone exposure and $Vk5_2$ denotes the holding rate after ozone exposure.

$$\Delta Vk5 = Vk5_2(\text{after ozone exposure})/Vk5_1(\text{before ozone exposure})$$

The tables below set out the electrical characteristics, in the form of the results of the above measurements, for the photoconductors produced in Examples 1 to 87 and Comparative Examples 1 to 5.

TABLE 4

| | Charge generation material*2 | Additive (parts by mass) Undercoat layer | Charge generation layer | Charge transport layer | Surface protective layer | Charge transport material | Vk5 (%) | E½ (μJcm$^{-2}$) | E50 (μJcm$^{-2}$) | Rate of change of ozone exposure holding ΔVk5 (%) |
|---|---|---|---|---|---|---|---|---|---|---|
| Example 1 | Y-TiOPc | — | — | I-1(10) | | II-1 | 94.5 | 0.15 | 1.04 | 96.3 |
| Example 2 | Y-TiOPc | — | — | I-2(10) | | II-1 | 92.3 | 0.17 | 0.92 | 96.1 |
| Example 3 | Y-TiOPc | — | — | I-3(10) | | II-1 | 95.2 | 0.17 | 1.05 | 96.2 |
| Example 4 | Y-TiOPc | — | — | I-4(10) | | II-1 | 93.2 | 0.16 | 1.10 | 98.1 |
| Example 5 | Y-TiOPc | — | — | I-5(10) | | II-1 | 93.1 | 0.15 | 1.01 | 98.3 |
| Example 6 | Y-TiOPc | — | — | I-6(10) | | II-1 | 93.0 | 0.13 | 0.98 | 97.2 |
| Example 7 | Y-TiOPc | — | — | I-7(10) | | II-1 | 92.9 | 0.13 | 1.20 | 94.4 |
| Example 8 | Y-TiOPc | — | — | I-8(10) | | II-1 | 94.5 | 0.14 | 0.97 | 94.9 |
| Example 9 | Y-TiOPc | — | — | I-9(10) | | II-1 | 94.9 | 0.12 | 1.06 | 96.3 |
| Example 10 | Y-TiOPc | — | — | I-10(10) | | II-1 | 94.5 | 0.17 | 1.22 | 96.4 |
| Example 11 | Y-TiOPc | — | — | I-11(10) | | II-1 | 94.8 | 0.18 | 1.11 | 98.2 |
| Example 12 | Y-TiOPc | — | — | I-12(10) | | II-1 | 95.2 | 0.14 | 1.09 | 96.3 |
| Example 13 | Y-TiOPc | — | — | I-13(10) | | II-1 | 94.6 | 0.13 | 1.03 | 96.5 |
| Example 14 | Y-TiOPc | — | — | I-14(10) | | II-1 | 94.2 | 0.14 | 1.02 | 96.6 |
| Example 15 | Y-TiOPc | — | — | I-15(10) | | II-1 | 94.7 | 0.11 | 0.95 | 96.8 |
| Example 16 | Y-TiOPc | — | — | I-16(10) | | II-1 | 93.6 | 0.17 | 1.03 | 96.4 |
| Example 17 | Y-TiOPc | — | — | I-17(10) | | II-1 | 93.2 | 0.18 | 1.08 | 97.2 |
| Example 18 | Y-TiOPc | — | — | I-18(10) | | II-1 | 95.1 | 0.14 | 1.14 | 98.1 |
| Example 19 | Y-TiOPc | — | — | I-19(10) | | II-1 | 93.2 | 0.16 | 0.96 | 97.3 |
| Example 20 | Y-TiOPc | — | — | I-20(10) | | II-1 | 94.2 | 0.16 | 1.14 | 94.9 |
| Example 21 | Y-TiOPc | — | — | I-21(10) | | II-1 | 94.2 | 0.16 | 0.99 | 94.2 |
| Example 22 | Y-TiOPc | — | — | I-22(10) | | II-1 | 94.5 | 0.16 | 1.03 | 96.8 |
| Example 23 | Y-TiOPc | — | — | I-23(10) | | II-1 | 94.6 | 0.15 | 1.02 | 96.3 |
| Example 24 | Y-TiOPc | — | — | I-24(10) | | II-1 | 93.8 | 0.17 | 1.09 | 98.1 |
| Example 25 | Y-TiOPc | — | — | I-25(10) | | II-1 | 94.1 | 0.19 | 1.13 | 95.4 |
| Example 26 | Y-TiOPc | — | — | I-26(10) | | II-1 | 94.5 | 0.16 | 1.08 | 96.5 |

TABLE 5

| | Charge generation material*2 | Additive (parts by mass) Undercoat layer | Charge generation layer | Charge transport layer | Surface protective layer | Charge transport material | Vk5 (%) | E½ (μJcm$^{-2}$) | E50 (μJcm$^{-2}$) | Rate of change of ozone exposure holding ΔVk5 (%) |
|---|---|---|---|---|---|---|---|---|---|---|
| Example 27 | Y-TiOPc | — | — | I-27(10) | | II-1 | 94.5 | 0.16 | 1.02 | 96.1 |
| Example 28 | Y-TiOPc | — | — | I-28(10) | | II-1 | 92.7 | 0.18 | 0.92 | 96.1 |
| Example 29 | Y-TiOPc | — | — | I-29(10) | | II-1 | 95.1 | 0.17 | 1.02 | 95.2 |
| Example 30 | Y-TiOPc | — | — | I-30(10) | | II-1 | 93.8 | 0.15 | 1.17 | 98.7 |
| Example 31 | Y-TiOPc | — | — | I-31(10) | | II-1 | 93.4 | 0.11 | 1.04 | 95.2 |
| Example 32 | Y-TiOPc | — | — | I-32(10) | | II-1 | 93.9 | 0.12 | 0.92 | 97.0 |
| Example 33 | Y-TiOPc | — | — | I-33(10) | | II-1 | 92.9 | 0.12 | 1.20 | 94.3 |
| Example 34 | Y-TiOPc | — | — | I-34(10) | | II-1 | 94.7 | 0.14 | 0.91 | 94.9 |
| Example 35 | Y-TiOPc | — | — | I-35(10) | | II-1 | 94.9 | 0.19 | 1.06 | 96.1 |
| Example 36 | Y-TiOPc | — | — | I-36(10) | | II-1 | 94.9 | 0.17 | 1.28 | 96.4 |
| Example 37 | Y-TiOPc | — | — | I-37(10) | | II-1 | 94.2 | 0.11 | 1.11 | 98.3 |
| Example 38 | Y-TiOPc | — | — | I-38(10) | | II-1 | 95.7 | 0.14 | 1.02 | 96.3 |
| Example 39 | Y-TiOPc | — | — | I-39(10) | | II-1 | 94.6 | 0.18 | 1.03 | 96.2 |
| Example 40 | Y-TiOPc | — | — | I-40(10) | | II-1 | 94.3 | 0.14 | 1.02 | 96.6 |
| Example 41 | Y-TiOPc | — | — | I-41(10) | | II-1 | 94.7 | 0.14 | 0.95 | 96.8 |
| Example 42 | Y-TiOPc | — | — | I-42(10) | | II-1 | 94.2 | 0.16 | 1.16 | 96.8 |
| Example 43 | Y-TiOPc | — | — | I-43(10) | | II-1 | 92.7 | 0.13 | 0.93 | 96.5 |
| Example 44 | Y-TiOPc | — | — | I-44(10) | | II-1 | 95.7 | 0.17 | 1.08 | 96.2 |
| Example 45 | Y-TiOPc | — | — | I-45(10) | | II-1 | 93.2 | 0.13 | 1.10 | 98.1 |
| Example 46 | Y-TiOPc | — | — | I-46(10) | | II-1 | 95.4 | 0.15 | 1.14 | 98.2 |
| Example 47 | Y-TiOPc | — | — | I-47(10) | | II-1 | 93.2 | 0.18 | 0.98 | 97.2 |
| Example 48 | Y-TiOPc | — | — | I-48(10) | | II-1 | 92.7 | 0.16 | 1.23 | 94.8 |
| Example 49 | Y-TiOPc | — | — | I-49(10) | | II-1 | 94.2 | 0.15 | 0.99 | 94.2 |
| Example 50 | Y-TiOPc | — | — | I-50(10) | | II-1 | 94.6 | 0.16 | 1.03 | 96.7 |
| Example 51 | Y-TiOPc | — | — | I-51(10) | | II-1 | 94.3 | 0.18 | 1.20 | 95.4 |

TABLE 6

| | Charge generation material*2 | Additive (parts by mass) Undercoat layer | Charge generation layer | Charge transport layer | Surface protective layer | Charge transport material | Vk5 (%) | E½ ($\mu Jcm^{-2}$) | E50 ($\mu Jcm^{-2}$) | Rate of change of ozone exposure holding ΔVk5 (%) |
|---|---|---|---|---|---|---|---|---|---|---|
| Example 52 | Y-TiOPc | — | — | I-52(10) | | II-1 | 94.2 | 0.16 | 1.16 | 98.3 |
| Example 53 | Y-TiOPc | — | — | I-53(10) | | II-1 | 95.2 | 0.14 | 1.05 | 96.3 |
| Example 54 | Y-TiOPc | — | — | I-54(10) | | II-1 | 94.6 | 0.13 | 1.03 | 94.7 |
| Example 55 | Y-TiOPc | — | — | I-55(10) | | II-1 | 95.3 | 0.14 | 1.02 | 96.6 |
| Example 56 | Y-TiOPc | — | — | I-56(10) | | II-1 | 93.2 | 0.17 | 1.10 | 98.2 |
| Example 57 | Y-TiOPc | — | — | I-57(10) | | II-1 | 93.1 | 0.15 | 1.06 | 98.2 |
| Example 58 | Y-TiOPc | — | — | I-58(10) | | II-1 | 93.2 | 0.18 | 0.98 | 97.3 |
| Example 59 | Y-TiOPc | — | — | I-59(10) | | II-1 | 94.8 | 0.17 | 1.25 | 96.4 |
| Example 60 | Y-TiOPc | — | — | I-60(10) | | II-1 | 94.8 | 0.12 | 1.11 | 98.5 |
| Example 61 | Y-TiOPc | — | — | I-61(10) | | II-1 | 95.1 | 0.14 | 1.08 | 96.3 |
| Example 62 | Y-TiOPc | — | — | I-62(10) | | II-1 | 94.6 | 0.13 | 1.03 | 96.2 |
| Example 63 | Y-TiOPc | — | — | I-63(10) | | II-1 | 94.2 | 0.14 | 1.04 | 96.6 |
| Example 64 | Y-TiOPc | — | — | I-64(10) | | II-1 | 94.7 | 0.19 | 0.95 | 96.5 |
| Example 65 | Y-TiOPc | — | — | I-65(10) | | II-1 | 94.8 | 0.16 | 1.03 | 96.8 |
| Example 66 | Y-TiOPc | — | — | I-66(10) | | II-1 | 92.7 | 0.18 | 0.93 | 96.6 |
| Example 67 | Y-TiOPc | — | — | I-67(10) | | II-1 | 95.8 | 0.17 | 1.05 | 96.2 |
| Example 68 | Y-TiOPc | — | — | I-68(10) | | II-1 | 93.2 | 0.16 | 1.10 | 97.7 |
| Example 69 | Y-TiOPc | — | — | I-69(10) | | II-1 | 93.8 | 0.15 | 1.07 | 98.2 |
| Example 70 | Y-TiOPc | — | — | I-70(10) | | II-1 | 93.2 | 0.18 | 0.98 | 96.0 |
| Example 71 | Y-TiOPc | — | — | I-71(10) | | II-1 | 94.7 | 0.17 | 1.25 | 96.4 |
| Example 72 | Y-TiOPc | — | — | I-72(10) | | II-1 | 94.8 | 0.17 | 1.11 | 98.5 |
| Example 73 | Y-TiOPc | — | — | I-73(10) | | II-1 | 94.3 | 0.15 | 1.08 | 97.7 |
| Example 74 | Y-TiOPc | — | — | I-74(10) | | II-1 | 95.1 | 0.16 | 1.01 | 96.3 |
| Example 75 | Y-TiOPc | — | — | I-75(10) | | II-1 | 96.0 | 0.13 | 1.11 | 96.7 |

TABLE 7

| | Charge generation material*2 | Additive (parts by mass) Undercoat layer | Charge generation layer | Charge transport layer | Surface protective layer | Charge transport material | Vk5 (%) | E½ ($\mu Jcm^{-2}$) | E50 ($\mu Jcm^{-2}$) | Rate of change of ozone exposure holding ΔVk5 (%) |
|---|---|---|---|---|---|---|---|---|---|---|
| Example 76 | Y-TiOPc | — | — | I-1(1) | | II-1 | 94.3 | 0.12 | 1.07 | 96.2 |
| Example 77 | Y-TiOPc | — | — | I-1(3) | | II-1 | 92.2 | 0.15 | 0.98 | 96.1 |
| Example 78 | Y-TiOPc | — | — | I-1(6) | | II-1 | 95.3 | 0.13 | 1.02 | 95.2 |
| Example 79 | Y-TiOPc | I-1(3) | — | — | | II-1 | 93.7 | 0.15 | 1.15 | 98.7 |
| Example 80 | Y-TiOPc | — | I-1(3) | — | | II-1 | 93.4 | 0.12 | 1.04 | 96.2 |
| Example 81 | Y-TiOPc | — | — | — | I-1(12) | II-1 | 94.2 | 0.12 | 0.94 | 97.0 |
| Example 82 | Y-TiOPc | I-1(3) | I-1(1) | — | | II-1 | 94.7 | 0.17 | 0.95 | 99.2 |
| Example 83 | Y-TiOPc | I-1(3) | — | I-1(3) | | II-1 | 94.5 | 0.16 | 1.03 | 96.8 |
| Example 84 | Y-TiOPc | — | I-1(3) | I-1(3) | | II-1 | 94.7 | 0.12 | 1.06 | 97.8 |
| Example 85 | Y-TiOPc | I-1(3) | I-1(1) | I-1(3) | | II-1 | 94.6 | 0.17 | 1.26 | 96.4 |
| Example 86 | α-TiOPc | — | — | I-1(10) | | II-1 | 94.8 | 0.18 | 1.11 | 98.5 |
| Example 87 | X-$H_2$Pc | — | — | I-1(10) | | II-1 | 95.8 | 0.14 | 1.04 | 96.3 |
| Comp. Ex. 1 | Y-TiOPc | — | — | — | | II-1 | 93.2 | 0.22 | 2.25 | 75.3 |
| Comp. Ex. 2 | Y-TiOPc | — | — | — | | II-1 | 93.0 | 0.31 | 2.90 | 76.2 |
| Comp. Ex. 3 | Y-TiOPc | — | — | Dioctyl phthalate (10) | | II-1 | 94.1 | 0.23 | 2.67 | 78.5 |
| Comp. Ex. 4 | α-TiOPc | — | — | — | | II-1 | 95.3 | 0.37 | 3.02 | 79.8 |
| Comp. Ex. 5 | X-$H_2$Pc | — | — | — | | II-1 | 94.7 | 0.33 | 2.85 | 76.8 |

*2Y-TiOPc denotes Y-type titanyl phthalocyanine, α-TiOPc denotes α-type titanyl phthalocyanine, and X-$H_2$Pc denotes X-type metal-free titanyl phthalocyanine.

The results in the tables revealed that using the compound according to the present invention as an additive in the various layers that make up the photoconductors did not exert a significant influence on initial electrical characteristics, while variation in the holding rate before and after ozone exposure was curtailed.

Sensitivity was slightly slower in Comparative Example 2, where, instead of adding the compound according to the present invention, the amount of resin binder used in the charge transport layer was increased, and the variation of the holding rate before and after ozone exposure was substantial. This showed that the effect afforded by using the compound according to the present invention cannot be elicited by simply increasing the amount of resin binder for the charge transport layer.

Even upon modification of the phthalocyanine, as the charge generation material, there was observed virtually no variation in the large initial sensitivity afforded by using the compound according to the present invention, and the variation of the holding rate before and after ozone exposure proved to be suppressed.

Next, the photoconductors produced in Examples 1 to 87 and Comparative Examples 1 to 5 were set in a digital copier (ImageRunner Color 2880, by Canon Inc.) of two-component development type, remodeled so as to enable measurement of the surface potential of the photoconductor. The potential stability, image memory and film scraping amount of the photosensitive layer caused by friction between paper and blade, after 100,000 copies in the copier, were evaluated. The results are given in the tables below.

Images were evaluated by reading the presence or absence of memory phenomena wherein, in printing evaluation of an image sample imparted with a checkered flag pattern on a first-half portion and with a halftone on a second-half portion, a checkered flag is reflected on the halftone portion. In the results, the rating O indicates that no memory was observed, A indicates that some memory was observed, and x indicates memory was clearly observable; instances where shading appeared identical to that in the original image were determined to be (positive), and instances where shading was the opposite of the original image, i.e. where a reverse image appeared, were determined to be (negative).

TABLE 8

| | Initial bright section potential (−V) | Initial image memory evaluation | Bright section potential after 100,000 prints (−V) | Variation in bright section potential (−V) | Image memory evaluation after repeated printing | Film scraping amount of photosensitive layer, before-after printing (μm) |
|---|---|---|---|---|---|---|
| Example 1 | 119 | ○ | 126 | 10 | ○ | 2.10 |
| Example 2 | 122 | ○ | 130 | 15 | ○ | 2.12 |
| Example 3 | 115 | ○ | 121 | 5 | ○ | 2.16 |
| Example 4 | 113 | ○ | 121 | 7 | ○ | 2.12 |
| Example 5 | 131 | ○ | 134 | 5 | ○ | 2.17 |
| Example 6 | 135 | ○ | 132 | 6 | ○ | 2.14 |
| Example 7 | 116 | ○ | 127 | 5 | ○ | 2.11 |
| Example 8 | 120 | ○ | 131 | 8 | ○ | 2.09 |
| Example 9 | 125 | ○ | 131 | 10 | ○ | 2.18 |
| Example 10 | 131 | ○ | 138 | 8 | ○ | 2.14 |
| Example 11 | 127 | ○ | 133 | 11 | ○ | 2.02 |
| Example 12 | 116 | ○ | 128 | 5 | ○ | 2.12 |
| Example 13 | 128 | ○ | 132 | 8 | ○ | 2.17 |
| Example 14 | 119 | ○ | 119 | 11 | ○ | 2.12 |
| Example 15 | 122 | ○ | 123 | 5 | ○ | 2.16 |
| Example 16 | 135 | ○ | 137 | 9 | ○ | 2.12 |
| Example 17 | 135 | ○ | 141 | 9 | ○ | 2.10 |
| Example 18 | 112 | ○ | 124 | 7 | ○ | 2.11 |
| Example 19 | 125 | ○ | 137 | 8 | ○ | 2.06 |
| Example 20 | 125 | ○ | 131 | 7 | ○ | 2.13 |
| Example 21 | 132 | ○ | 132 | 6 | ○ | 2.16 |
| Example 22 | 132 | ○ | 140 | 8 | ○ | 2.11 |
| Example 23 | 118 | ○ | 123 | 9 | ○ | 2.18 |
| Example 24 | 127 | ○ | 128 | 6 | ○ | 2.12 |
| Example 25 | 118 | ○ | 121 | 10 | ○ | 2.18 |
| Example 26 | 123 | ○ | 139 | 12 | ○ | 2.13 |

TABLE 9

| | Initial bright section potential (−V) | Initial image memory evaluation | Bright section potential after 100,000 prints (−V) | Variation in bright section potential (−V) | Image memory evaluation after repeated printing | Film scraping amount of photosensitive layer, before-after printing (μm) |
|---|---|---|---|---|---|---|
| Example 27 | 122 | ○ | 130 | 14 | ○ | 2.17 |
| Example 28 | 131 | ○ | 140 | 6 | ○ | 2.11 |
| Example 29 | 118 | ○ | 129 | 6 | ○ | 2.18 |
| Example 30 | 123 | ○ | 133 | 8 | ○ | 2.15 |
| Example 31 | 121 | ○ | 137 | 10 | ○ | 2.10 |
| Example 32 | 134 | ○ | 138 | 8 | ○ | 2.11 |
| Example 33 | 137 | ○ | 143 | 5 | ○ | 2.16 |
| Example 34 | 122 | ○ | 136 | 9 | ○ | 2.09 |
| Example 35 | 126 | ○ | 135 | 6 | ○ | 2.18 |
| Example 36 | 134 | ○ | 137 | 8 | ○ | 2.11 |
| Example 37 | 141 | ○ | 141 | 6 | ○ | 2.23 |
| Example 38 | 117 | ○ | 124 | 11 | ○ | 2.13 |
| Example 39 | 122 | ○ | 132 | 8 | ○ | 2.17 |
| Example 40 | 116 | ○ | 123 | 12 | ○ | 2.11 |
| Example 41 | 117 | ○ | 122 | 10 | ○ | 2.20 |
| Example 42 | 131 | ○ | 130 | 6 | ○ | 2.08 |
| Example 43 | 133 | ○ | 132 | 1 | ○ | 2.15 |
| Example 44 | 114 | ○ | 124 | 8 | ○ | 2.13 |
| Example 45 | 127 | ○ | 132 | 6 | ○ | 2.18 |
| Example 46 | 125 | ○ | 132 | 7 | ○ | 2.16 |
| Example 47 | 131 | ○ | 132 | 4 | ○ | 2.08 |
| Example 48 | 123 | ○ | 133 | 9 | ○ | 2.15 |
| Example 49 | 116 | ○ | 122 | 8 | ○ | 2.21 |
| Example 50 | 122 | ○ | 136 | 14 | ○ | 2.19 |
| Example 51 | 114 | ○ | 121 | 10 | ○ | 2.25 |

TABLE 10

| | Initial bright section potential (−V) | Initial image memory evaluation | Bright section potential after 100,000 prints (−V) | Variation in bright section potential (−V) | Image memory evaluation after repeated printing | Film scraping amount of photosensitive layer, before-after printing (μm) |
|---|---|---|---|---|---|---|
| Example 52 | 121 | ○ | 123 | 8 | ○ | 2.12 |
| Example 53 | 125 | ○ | 136 | 9 | ○ | 2.25 |
| Example 54 | 134 | ○ | 132 | 8 | ○ | 2.12 |
| Example 55 | 114 | ○ | 125 | 5 | ○ | 2.18 |
| Example 56 | 127 | ○ | 131 | 7 | ○ | 2.13 |
| Example 57 | 126 | ○ | 133 | 11 | ○ | 2.05 |
| Example 58 | 130 | ○ | 132 | 7 | ○ | 2.11 |
| Example 59 | 136 | ○ | 139 | 5 | ○ | 2.19 |
| Example 60 | 115 | ○ | 121 | 13 | ○ | 2.20 |
| Example 61 | 114 | ○ | 124 | 7 | ○ | 2.18 |
| Example 62 | 117 | ○ | 126 | 8 | ○ | 2.21 |
| Example 63 | 123 | ○ | 135 | 7 | ○ | 2.10 |
| Example 64 | 128 | ○ | 131 | 8 | ○ | 2.18 |
| Example 65 | 132 | ○ | 139 | 9 | ○ | 2.17 |
| Example 66 | 119 | ○ | 121 | 5 | ○ | 2.11 |
| Example 67 | 127 | ○ | 134 | 12 | ○ | 2.11 |
| Example 68 | 125 | ○ | 122 | 7 | ○ | 2.15 |
| Example 69 | 133 | ○ | 136 | 8 | ○ | 2.13 |
| Example 70 | 132 | ○ | 131 | 8 | ○ | 2.17 |
| Example 71 | 126 | ○ | 131 | 13 | ○ | 2.06 |
| Example 72 | 125 | ○ | 135 | 8 | ○ | 2.14 |
| Example 73 | 122 | ○ | 129 | 10 | ○ | 2.04 |
| Example 74 | 119 | ○ | 122 | 9 | ○ | 2.08 |
| Example 75 | 123 | ○ | 118 | 11 | ○ | 2.15 |

TABLE 11

| | Initial bright section potential (−V) | Initial image memory evaluation | Bright section potential after 100,000 prints (−V) | Variation in bright section potential (−V) | Image memory evaluation after repeated printing | Film scraping amount of photosensitive layer, before-after printing (μm) |
|---|---|---|---|---|---|---|
| Example 76 | 119 | ○ | 123 | 7 | ○ | 2.26 |
| Example 77 | 115 | ○ | 122 | 10 | ○ | 2.32 |
| Example 78 | 136 | ○ | 137 | 9 | ○ | 2.27 |
| Example 79 | 134 | ○ | 131 | 5 | ○ | 2.14 |
| Example 80 | 112 | ○ | 126 | 8 | ○ | 2.15 |
| Example 81 | 124 | ○ | 123 | 9 | ○ | 2.19 |
| Example 82 | 122 | ○ | 130 | 11 | ○ | 2.18 |
| Example 83 | 135 | ○ | 129 | 4 | ○ | 2.26 |
| Example 84 | 123 | ○ | 137 | 5 | ○ | 2.06 |
| Example 85 | 121 | ○ | 126 | 6 | ○ | 2.25 |
| Example 86 | 120 | ○ | 133 | 13 | ○ | 2.14 |
| Example 87 | 118 | ○ | 125 | 5 | ○ | 2.25 |
| Comp. Ex. 1 | 132 | ○ | 146 | 12 | ○ | 4.75 |
| Comp. Ex. 2 | 131 | ○ | 145 | 11 | ○ | 4.55 |
| Comp. Ex. 3 | 125 | ○ | 131 | 13 | ○ | 4.61 |
| Comp. Ex. 4 | 222 | ○ | 221 | 7 | ○ | 4.38 |
| Comp. Ex. 5 | 235 | ○ | 242 | 17 | ○ | 4.56 |

The results in the tables showed that adding the compound according to the present invention to the layers did not result in significantly observable differences in initial actual-equipment electrical characteristics, as compared with instances where the compound was not added, and that it was possible to reduce by 50% or more the film scraping amount after repeated printing of 100,000 copies. Further, no problems were observed as regards potential and image evaluation after printing.

Next, the potential characteristic of the photoconductors for each usage environment, from low-temperature and low-humidity to high-temperature, high-humidity was assessed, in the above digital copier, and image evaluation was performed at the same time. The results are given in the tables below.

TABLE 12

| | Low-temperature, low-humidity*3 (−V) | Normal-temperature, normal-humidity*4 (−V) | High-temperature, high-humidity*5 (−V) | Residual potential variation between low-temperature, low-humidity and high-temperature, high-humidity (−V) | Memory evaluation at high-temperature, high-humidity | Memory evaluation at low-temperature, low-humidity |
|---|---|---|---|---|---|---|
| Example 1 | 132 | 111 | 57 | 85 | ○ | ○ |
| Example 2 | 157 | 123 | 74 | 79 | ○ | ○ |
| Example 3 | 145 | 125 | 52 | 98 | ○ | ○ |
| Example 4 | 132 | 124 | 58 | 80 | ○ | ○ |
| Example 5 | 145 | 120 | 62 | 85 | ○ | ○ |
| Example 6 | 147 | 136 | 69 | 81 | ○ | ○ |
| Example 7 | 154 | 113 | 66 | 84 | ○ | ○ |
| Example 8 | 168 | 123 | 75 | 90 | ○ | ○ |
| Example 9 | 163 | 121 | 70 | 97 | ○ | ○ |
| Example 10 | 152 | 133 | 83 | 77 | ○ | ○ |
| Example 11 | 156 | 141 | 81 | 85 | ○ | ○ |
| Example 12 | 168 | 152 | 76 | 91 | ○ | ○ |
| Example 13 | 151 | 143 | 56 | 97 | ○ | ○ |
| Example 14 | 162 | 125 | 83 | 87 | ○ | ○ |
| Example 15 | 168 | 123 | 80 | 82 | ○ | ○ |
| Example 16 | 158 | 119 | 75 | 79 | ○ | ○ |
| Example 17 | 171 | 121 | 84 | 89 | ○ | ○ |
| Example 18 | 153 | 132 | 87 | 75 | ○ | ○ |
| Example 19 | 143 | 129 | 54 | 86 | ○ | ○ |
| Example 20 | 158 | 125 | 75 | 83 | ○ | ○ |
| Example 21 | 156 | 113 | 72 | 88 | ○ | ○ |
| Example 22 | 142 | 122 | 86 | 71 | ○ | ○ |
| Example 23 | 153 | 135 | 62 | 81 | ○ | ○ |
| Example 24 | 153 | 147 | 75 | 92 | ○ | ○ |
| Example 25 | 168 | 132 | 86 | 87 | ○ | ○ |
| Example 26 | 156 | 128 | 78 | 81 | ○ | ○ |

TABLE 13

| | Low-temperature, low-humidity*3 (−V) | Normal-temperature, normal-humidity*4 (−V) | High-temperature, high-humidity*5 (−V) | Residual potential variation between low-temperature, low-humidity and high-temperature, high-humidity (−V) | Memory evaluation at high-temperature, high-humidity | Memory evaluation at low-temperature, low-humidity |
|---|---|---|---|---|---|---|
| Example 27 | 157 | 121 | 78 | 71 | ○ | ○ |
| Example 28 | 167 | 135 | 90 | 84 | ○ | ○ |
| Example 29 | 159 | 140 | 81 | 72 | ○ | ○ |
| Example 30 | 176 | 162 | 125 | 65 | ○ | ○ |
| Example 31 | 185 | 145 | 100 | 89 | ○ | ○ |
| Example 32 | 165 | 125 | 78 | 86 | ○ | ○ |
| Example 33 | 165 | 138 | 71 | 84 | ○ | ○ |
| Example 34 | 178 | 118 | 92 | 79 | ○ | ○ |
| Example 35 | 161 | 143 | 64 | 95 | ○ | ○ |
| Example 36 | 151 | 118 | 85 | 75 | ○ | ○ |
| Example 37 | 138 | 116 | 54 | 88 | ○ | ○ |
| Example 38 | 143 | 113 | 76 | 77 | ○ | ○ |
| Example 39 | 147 | 118 | 52 | 93 | ○ | ○ |
| Example 40 | 136 | 122 | 56 | 83 | ○ | ○ |
| Example 41 | 141 | 121 | 62 | 89 | ○ | ○ |
| Example 42 | 147 | 132 | 68 | 77 | ○ | ○ |
| Example 43 | 150 | 113 | 66 | 94 | ○ | ○ |
| Example 44 | 152 | 126 | 76 | 87 | ○ | ○ |
| Example 45 | 164 | 125 | 70 | 95 | ○ | ○ |
| Example 46 | 155 | 131 | 83 | 72 | ○ | ○ |
| Example 47 | 158 | 142 | 81 | 79 | ○ | ○ |
| Example 48 | 163 | 148 | 76 | 89 | ○ | ○ |
| Example 49 | 154 | 142 | 56 | 96 | ○ | ○ |
| Example 50 | 152 | 129 | 76 | 89 | ○ | ○ |
| Example 51 | 165 | 126 | 80 | 88 | ○ | ○ |

TABLE 14

| | Low-temperature, low-humidity*3 (−V) | Normal-temperature, normal-humidity*4 (−V) | High-temperature, high-humidity*5 (−V) | Residual potential variation between low-temperature, low-humidity and high-temperature, high-humidity (−V) | Memory evaluation at high-temperature, high-humidity | Memory evaluation at low-temperature, low-humidity |
|---|---|---|---|---|---|---|
| Example 52 | 153 | 112 | 86 | 85 | ○ | ○ |
| Example 53 | 162 | 122 | 89 | 85 | ○ | ○ |
| Example 54 | 158 | 124 | 80 | 77 | ○ | ○ |
| Example 55 | 149 | 122 | 58 | 92 | ○ | ○ |
| Example 56 | 158 | 121 | 72 | 96 | ○ | ○ |
| Example 57 | 152 | 121 | 78 | 85 | ○ | ○ |
| Example 58 | 149 | 126 | 76 | 78 | ○ | ○ |
| Example 59 | 153 | 126 | 68 | 94 | ○ | ○ |
| Example 60 | 154 | 147 | 65 | 83 | ○ | ○ |
| Example 61 | 161 | 132 | 88 | 80 | ○ | ○ |
| Example 62 | 157 | 122 | 72 | 88 | ○ | ○ |
| Example 63 | 154 | 122 | 75 | 82 | ○ | ○ |
| Example 64 | 166 | 122 | 80 | 89 | ○ | ○ |
| Example 65 | 153 | 149 | 83 | 77 | ○ | ○ |
| Example 66 | 171 | 157 | 121 | 68 | ○ | ○ |
| Example 67 | 183 | 145 | 100 | 87 | ○ | ○ |
| Example 68 | 154 | 128 | 75 | 88 | ○ | ○ |
| Example 69 | 168 | 126 | 71 | 91 | ○ | ○ |
| Example 70 | 162 | 114 | 86 | 76 | ○ | ○ |
| Example 71 | 165 | 153 | 64 | 102 | ○ | ○ |
| Example 72 | 152 | 119 | 83 | 74 | ○ | ○ |
| Example 73 | 157 | 123 | 87 | 80 | ○ | ○ |
| Example 74 | 160 | 128 | 96 | 76 | ○ | ○ |
| Example 75 | 154 | 121 | 101 | 87 | ○ | ○ |

TABLE 15

| | Low-temperature, low-humidity*3 (−V) | Normal-temperature, normal-humidity*4 (−V) | High-temperature, high-humidity*5 (−V) | Residual potential variation between low-temperature, low-humidity and high-temperature, high-humidity (−V) | Memory evaluation at high-temperature, high-humidity | Memory evaluation at low-temperature, low-humidity |
|---|---|---|---|---|---|---|
| Example 76 | 162 | 135 | 73 | 85 | ○ | ○ |
| Example 77 | 152 | 128 | 76 | 91 | ○ | ○ |
| Example 78 | 173 | 114 | 96 | 87 | ○ | ○ |
| Example 79 | 143 | 130 | 72 | 84 | ○ | ○ |
| Example 80 | 142 | 132 | 65 | 79 | ○ | ○ |
| Example 81 | 153 | 117 | 68 | 85 | ○ | ○ |
| Example 82 | 160 | 127 | 72 | 82 | ○ | ○ |
| Example 83 | 154 | 129 | 76 | 91 | ○ | ○ |
| Example 84 | 155 | 135 | 80 | 76 | ○ | ○ |
| Example 85 | 156 | 142 | 84 | 71 | ○ | ○ |
| Example 86 | 165 | 153 | 82 | 85 | ○ | ○ |
| Example 87 | 158 | 141 | 77 | 80 | ○ | ○ |
| Comp. Ex. 1 | 178 | 132 | 68 | 119 | Δ(positive) | X(negative) |
| Comp. Ex. 2 | 172 | 124 | 57 | 123 | Δ(positive) | X(negative) |
| Comp. Ex. 3 | 239 | 123 | 95 | 132 | Δ(positive) | X(negative) |
| Comp. Ex. 4 | 275 | 232 | 135 | 146 | Δ(positive) | X(negative) |
| Comp. Ex. 5 | 328 | 293 | 167 | 141 | Δ(positive) | X(negative) |

*3temperature 5° C., humidity 10%
*4temperature 25° C., humidity 50%
*5temperature 35° C., humidity 85%

The results in the table showed that using the compound according to the present invention resulted in reduced environment dependence of potential and images, and revealed, in particular, that memory was significantly improved at low-temperature and low-humidity.

Production Examples of Positive Charging Single-Layer-Type Photoconductors

Example 88

The outer periphery of an aluminum cylinder having an outer diameter of 24 mm, as a conductive substrate, was dip-coated in an coating solution prepared by dissolving and dispersing, in 90 parts by mass of methanol, 5 parts by mass of alcohol-soluble nylon (trade name "Amilan CM8000", by TORAY INDUSTRIES, INC.) and 5 parts by mass of titanium oxide microparticles having undergone an aminosilane treatment; followed by 30 minutes of drying at a temperature of 100° C., to form thereby an undercoat layer having a thickness of about 2 μm.

Then, 7.0 parts by mass of a styryl compound represented by Formula (II-12) above, as a hole transport substance, 3 parts by mass of the compound represented by Formula (III-1) below, as an electron transport substance, 9.6 parts by mass of a polycarbonate resin (trade name "Panlite TS-2050", by TEIJIN CHEMICALS LTD.), as a resin binder, 0.04 parts by mass of a silicone oil (trade name, "KF-54", by Shin-Etsu Polymer Co., Ltd.), and 1.5 parts by mass of the compound represented by Formula (I-1) above were dissolved in 100 parts by mass of methylene chloride, whereupon 0.3 parts by mass of the X-type metal-free phthalocyanine disclosed in U.S. Pat. No. 3,357,989 (Specification), as a charge generation substance, were also added; thereafter, the whole was dispersed in a sand grinding mill, to prepare a coating solution. A coating film was formed on the undercoat layer using the coating solution, and the whole was dried for 60 minutes at a temperature of 100° C., to form thereby a single-layer-type photosensitive layer about 25 μm thick, and yield a positive charging single-layer-type electrophotographic photoconductor.

(III-I)

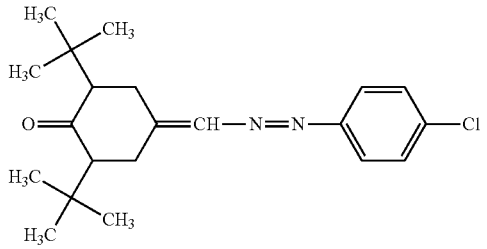

Examples 89 to 92

Electrophotographic photoconductors were produced in the same way as in Example 88, except that herein the compound represented by Formula (I-1) above, used in Example 88, was changed to the compounds represented by structural formulas (I-2), (I-21), (I-29), (I-37) above.

Comparative Example 6

An electrophotographic photoconductor was produced in the same way as in Example 88, except that herein the compound represented by Formula (I-1) above was not used.

Comparative Example 7

An electrophotographic photoconductor was produced in the same way as in Example 88, except that herein the compound represented by Formula (I-1) above used in Example 88 was changed to dioctyl phthalate (by Wako Pure Chemical Industries, Ltd.).

The photoconductors produced in Examples 88 to 92 and Comparative Examples 6 and 7 were evaluated in accordance with the below-described method. Specifically, the photoconductor surface was charged to +650 V through corona discharge in the dark, and thereafter the surface potential $V_0$ immediately after charging was measured. Next, the photoconductor was left to stand in the dark for 5 seconds, the surface potential V5 was measured, and the potential holding rate Vk5(%) after 5 seconds from charging was worked out in accordance with the expression below.

$$Vk5=V5/V0\times100$$

With a halogen lamp as a light source, exposure light of 1.0 $\mu W/cm^2$ resolved to 780 nm using a filter was irradiated next onto the photoconductor for 5 seconds from the point in time at which the surface potential reached +600 V; the exposure amount required for optical attenuation such that the surface potential reached +300 V was worked out as E1/2 ($\mu cm^{-2}$), and the exposure amount required for optical attenuation to +50 V was worked out as sensitivity E50 ($\mu Jcm^{-2}$).

The photoconductors produced in Examples 88 to 92 and Comparative Examples 6 and 7 were arranged in an ozone exposure device in which a photoconductor could be exposed to an ozone atmosphere, and ozone exposure was performed at 100 ppm for 2 hours. Thereafter, the abovementioned potential holding rate was measured again, and the degree of change of the holding rate Vk5 before and after ozone exposure was worked out, to yield a rate of change of ozone exposure holding (ΔVk5) as a percentage. The rate of change of ozone exposure holding is worked out in accordance with the expression below, where $Vk5_1$ denotes the holding rate before ozone exposure and $Vk5_2$ denotes the holding rate after ozone exposure.

$$\Delta Vk5=Vk5_2(\text{after ozone exposure})/Vk5_1(\text{before ozone exposure})$$

The table below sets out the electrical characteristics, in the form of the results of the above measurements, for the photoconductors produced in Examples 88 to 92 and Comparative Examples 6 and 7.

TABLE 16

| | Charge generation material*6 | Additive (parts by mass) | Charge transport material | Electron transport material | Vk5 (%) | E½ ($\mu Jcm^{-2}$) | E50 ($\mu Jcm^{-2}$) | Rate of change of ozone exposure holding (ΔVk5)(%) |
|---|---|---|---|---|---|---|---|---|
| Example 88 | X-$H_2$Pc | I-1(1.5) | II-12 | III-1 | 87.6 | 0.49 | 2.35 | 94.1 |
| Example 89 | X-$H_2$Pc | I-2(1.5) | II-12 | III-1 | 85.8 | 0.48 | 2.82 | 94.8 |
| Example 90 | X-$H_2$Pc | I-21(1.5) | II-12 | III-1 | 85.3 | 0.57 | 2.50 | 96.2 |
| Example 91 | X-$H_2$Pc | I-29(1.5) | II-12 | III-1 | 86.3 | 0.46 | 2.42 | 94.7 |
| Example 92 | X-$H_2$Pc | I-37(1.5) | II-12 | III-1 | 86.8 | 0.41 | 2.57 | 94.2 |
| Comp. Ex. 6 | X-$H_2$Pc | — | II-12 | III-1 | 85.6 | 0.5 | 2.52 | 76.7 |

TABLE 16-continued

| | Charge generation material*6 | Additive (parts by mass) | Charge transport material | Electron transport material | Vk5 (%) | E½ ($\mu Jcm^{-2}$) | E50 ($\mu Jcm^{-2}$) | Rate of change of ozone exposure holding (ΔVk5)(%) |
|---|---|---|---|---|---|---|---|---|
| Comp. Ex. 7 | X-$H_2$Pc | Dioctyl phthalate (1.5) | II-12 | III-1 | 85.5 | 0.54 | 2.84 | 76.8 |

*6X-$H_2$Pc denotes X-type metal-free phthalocyanine.

The results in the table revealed that using the compound according to the present invention as an additive in the various layers did not exert a significant influence on initial electrical characteristics, while variation in the holding rate before and after ozone exposure was curtailed.

Next, the photoconductors produced in Examples 88 to 92 and Comparative Examples 6 and 7 were set in a printer HL-2040, by BROTHER INDUSTRIES, LTD., remodeled so as to enable measurement of the surface potential of the photoconductor. The potential stability, image memory and film scraping amount of the photosensitive layer caused by friction between paper and blade, after about 10,000 copies in the printer, were evaluated. The results are given in the tables below.

Images were evaluated by reading the presence or absence of memory phenomena wherein, in printing evaluation of an image sample imparted with a checkered flag pattern on a first-half portion and with a halftone on a second-half portion, a checkered flag is reflected on the halftone portion. In the results, the rating O indicates that no memory was observed, Δ indicates that some memory was observed, and x indicates that memory was clearly observable; instances where shading appeared identical to that in the original image were determined as (positive), and instances where shading was the opposite of the original image, i.e. where a reverse image appeared, were determined as (negative).

TABLE 17

| | Initial bright section potential (−V) | Initial image memory evaluation | Bright section potential after 10,000 prints (V) | Variation in bright section potential (V) | Image memory evaluation after repeated printing | Film scraping amount of photosensitive layer, before-after printing (μm) |
|---|---|---|---|---|---|---|
| Example 88 | 113 | ○ | 122 | 10 | ○ | 2.23 |
| Example 89 | 134 | ○ | 132 | 14 | ○ | 2.38 |
| Example 90 | 121 | ○ | 125 | 6 | ○ | 2.16 |
| Example 91 | 112 | ○ | 123 | 11 | ○ | 2.15 |
| Example 92 | 121 | ○ | 131 | 9 | ○ | 2.13 |
| Comp. Ex. 6 | 138 | ○ | 143 | 18 | ○ | 4.86 |
| Comp. Ex. 7 | 131 | ○ | 134 | 11 | ○ | 4.79 |

The results in the tables showed that adding the compound according to the present invention to the layers did not result in significantly observable differences in initial actual-equipment electrical characteristics as compared with instances where the compound was not added, and that it was possible to reduce by 50% or more the film scraping amount after repeated printing of 10,000 copies. Further, no problems were observed as regards potential and image evaluation after printing.

Next, the potential characteristic of the photoconductors for each usage environment, from low-temperature low-humidity to high-temperature, high-humidity, was assessed, in the above printer, and image evaluation was performed at the same time. The results are given in the table below.

TABLE 18

| | Low-temperature, low-humidity*3 (V) | Normal-temperature, normal-humidity*4 (V) | High-temperature, high-humidity*5 (V) | Residual potential variation between low-temperature, low-humidity and high-temperature, high-humidity (V) | Memory evaluation at high-temperature, high-humidity | Memory evaluation at low-temperature, low-humidity |
|---|---|---|---|---|---|---|
| Example 88 | 152 | 131 | 79 | 86 | ○ | ○ |
| Example 89 | 164 | 142 | 87 | 80 | ○ | ○ |
| Example 90 | 179 | 162 | 106 | 78 | ○ | ○ |

TABLE 18-continued

| | Low-temperature, low-humidity*3 (V) | Normal-temperature, normal-humidity*4 (V) | High-temperature, high-humidity*5 (V) | Residual potential variation between low-temperature, low-humidity and high-temperature, high-humidity (V) | Memory evaluation at high-temperature, high-humidity | Memory evaluation at low-temperature, low-humidity |
|---|---|---|---|---|---|---|
| Example 91 | 182 | 147 | 115 | 69 | ○ | ○ |
| Example 92 | 168 | 134 | 88 | 85 | ○ | ○ |
| Comp. Ex. 6 | 177 | 136 | 63 | 118 | Δ (positive) | X (negative) |
| Comp. Ex. 7 | 180 | 132 | 55 | 129 | Δ (positive) | X (negative) |

The results in the table showed that using the compound according to the present invention resulted in reduced environment dependence of potential and images, and revealed, in particular, that memory was significantly improved at low-temperature and low-humidity.

Production of a Positive Charging Multilayer-Type Photoconductor

Example 93

A coating solution was prepared by dissolving, in 800 parts by mass of dichloromethane, 50 parts by mass of the compound represented by Formula (II-15) above, as a charge transport material, 50 parts by mass of a polycarbonate resin (trade name "Panlite TS-2050" by TEIJIN CHEMICALS LTD.), as a resin binder, and 1.5 parts by mass of the compound represented by Formula (I-1) above. The outer periphery of an aluminum cylinder having an outer diameter of 24 mm, as a conductive substrate, was dip-coated in the coating solution, followed by drying for 60 minutes at a temperature of 120° C., to form a charge transport layer 15 μm thick.

The charge transport layer was dip-coated with a coating solution prepared by dissolving and dispersing, in 800 parts by mass of 1,2-dichloroethane, 1.5 parts by mass of the X-type metal-free phthalocyanine disclosed in U.S. Pat. No. 3,357,989 (Specification), as a charge generation substance, 10 parts by mass of a stilbene compound represented by Formula (II-15), as a hole transport material, 25 parts by mass of the compound represented by Formula (III-1), as an electron transport material, and 60 parts by mass of a polycarbonate resin (trade name "Panlite TS-2050", by TEIJIN CHEMICALS LTD.), as a resin binder; this was followed by 60 minutes drying at a temperature of 100° C., to form thereby a charge generation layer having a thickness of about 15 μm, and produce a positive charging multilayer-type photoconductor.

Example 94

A coating solution was prepared by dissolving, in 800 parts by mass of dichloromethane, 50 parts by mass of the compound represented by Formula (II-15), as a charge transport material, and 50 parts by mass of a polycarbonate resin (trade name "Panlite TS-2050", by TEIJIN CHEMICALS LTD.), as a resin binder. The outer periphery of an aluminum cylinder having an outer diameter of 24 mm, as a conductive substrate, was dip-coated in the coating solution, followed by drying for 60 minutes at a temperature of 120° C., to form a charge transport layer 15 μm thick.

The charge transport layer was dip-coated with a coating solution prepared by dissolving and dispersing, in 800 parts by mass of 1,2-dichloroethane, 1.5 parts by mass of the X-type metal-free phthalocyanine disclosed in U.S. Pat. No. 3,357,989 (Specification), as a charge generation substance, 10 parts by mass of a stilbene compound represented by Formula (II-15), as a hole transport material, 25 parts by mass of the compound represented by Formula (III-1), as an electron transport material, 60 parts by mass of a polycarbonate resin (trade name "Panlite TS-2050", by TEIJIN CHEMICALS LTD.), as a resin binder, and 1.5 parts by mass of the compound represented by Formula (I-1) above; this was followed by 60 minutes drying at a temperature of 100° C., to form thereby a charge generation layer having a thickness of about 15 μm, and produce a positive charging multilayer-type photoconductor.

Example 95

A coating solution was prepared by dissolving, in 800 parts by mass of dichloromethane, 50 parts by mass of the compound represented by Formula (II-15) above, as a charge transport material, 50 parts by mass of a polycarbonate resin (trade name "Panlite TS-2050" by TEIJIN CHEMICALS LTD.), as a resin binder, and 1.5 parts by mass of the compound represented by Formula (I-1) above. The outer periphery of an aluminum cylinder having an outer diameter of 24 mm, as a conductive substrate, was dip-coated in the coating solution, followed by drying for 60 minutes at a temperature of 120° C., to form a charge transport layer 15 μm thick.

The charge transport layer was dip-coated with a coating solution prepared by dissolving and dispersing, in 800 parts by mass of 1,2-dichloroethane, 1.5 parts by mass of the X-type metal-free phthalocyanine disclosed in U.S. Pat. No. 3,357,989 (Specification), as a charge generation substance, 10 parts by mass of a stilbene compound represented by Formula (II-15), as a hole transport material, 25 parts by mass of the compound represented by Formula (III-1), as an electron transport material, 60 parts by mass of a polycarbonate resin (trade name "Panlite TS-2050", by TEIJIN CHEMICALS LTD.), as a resin binder, and 1.5 parts by mass of the compound represented by Formula (I-1) above; this was followed by 60 minutes drying at a temperature of 100° C., to form thereby a charge generation layer having a thickness of about 15 μm, and produce a positive charging multilayer-type photoconductor.

Comparative Example 8

An electrophotographic photoconductor was produced in the same way as in Example 93, except that herein the compound represented by Formula (I-1) above was not used.

Comparative Example 9

An electrophotographic photoconductor was produced in the same way as in Example 95, except that herein the compound represented by Formula (I-1) above used in Example 95 was changed to dioctyl phthalate (by Wako Pure Chemical Industries, Ltd.).

The photoconductors produced in Examples 93 to 95 and Comparative Examples 8 and 9 were evaluated in accordance with the same method in Example 92 and so forth.

The table below sets out the electrical characteristics, in the form of the results of the above measurements, for the photoconductors produced in Examples 93 to 95 and Comparative Examples 8 and 9.

TABLE 19

| | Charge generation material*7 | Additive (parts by mass) Charge transport layer | Charge generation layer | Charge transport material | Electron transport material | Vk5 (%) | E½ ($\mu Jcm^{-2}$) | E50 ($\mu Jcm^{-2}$) | Rate of change of ozone exposure holding ΔVk5 (%) |
|---|---|---|---|---|---|---|---|---|---|
| Example 93 | X-$H_2$Pc | I-1 (1.5) | — | II-15 | III-1 | 87.3 | 0.32 | 2.32 | 96.2 |
| Example 94 | X-$H_2$Pc | — | I-1 (1.5) | II-15 | III-1 | 88.2 | 0.33 | 2.34 | 96.8 |
| Example 95 | X-$H_2$Pc | I-1 | I-1 (1.5) | II-15 (1.5) | III-1 | 85.6 | 0.31 | 2.37 | 95.4 |
| Comp. Ex. 8 | X-$H_2$Pc | — | — | II-15 | III-1 | 85.1 | 0.56 | 2.57 | 78.3 |
| Comp. Ex. 9 | X-$H_2$Pc | Dioctyl phthalate (1.5) | Dioctyl phthalate (1.5) | II-15 | III-1 | 86.6 | 0.56 | 2.76 | 79.8 |

*7X-$H_2$Pc denotes X-type metal-free phthalocyanine.

The results in the table revealed that using the compound according to the present invention as an additive in the various layers did not exert a significant influence on initial electrical characteristics, while variation in the holding rate before and after ozone exposure was curtailed.

Next, the photoconductors produced in Examples 93 to 95 and Comparative Examples 8 and 9 were set in a printer HL-2040, by BROTHER INDUSTRIES, LTD., remodeled so as to enable measurement of the surface potential of the photoconductor. The potential stability, image memory and film scraping amount of the photosensitive layer caused by friction between paper and blade, after about 10,000 copies in the printer, were evaluated. The results are given in the table below.

Image evaluation was performed in accordance with the same method as in Example 92 and so forth.

TABLE 20

| | Initial bright section potential (−V) | Initial image memory evaluation | Bright section potential after 10,000 prints (V) | Variation in bright section potential (V) | Image memory evaluation after repeated printing | Film scraping amount of photosensitive layer, before-after printing (μm) |
|---|---|---|---|---|---|---|
| Example 93 | 116 | ○ | 125 | 9 | ○ | 2.22 |
| Example 94 | 126 | ○ | 135 | 14 | ○ | 2.25 |
| Example 95 | 116 | ○ | 123 | 7 | ○ | 2.25 |
| Comp. Ex. 8 | 144 | ○ | 145 | 10 | ○ | 4.65 |
| Comp. Ex. 9 | 135 | ○ | 156 | 11 | ○ | 4.88 |

The results in the table showed that adding the compound according to the present invention to the layers did not result in significantly observable differences in initial actual-equipment electrical characteristics as compared with instances where the compound was not added, and that it was possible to reduce by 50% or more the film scraping amount after repeated printing of 10,000 copies. Further, no problems were observed as regards potential and image evaluation after printing.

Next, the potential characteristic of the photoconductors for each usage environment, from low-temperature low-humidity to high-temperature, high-humidity, was assessed, in the above digital copier, and image evaluation was performed at the same time. The results are given in the table below.

TABLE 21

| | Low-temperature, low-humidity*3 (V) | Normal-temperature, normal-humidity*4 (V) | High-temperature, high-humidity*5 (V) | Residual potential variation between low-temperature, low-humidity and high-temperature, high-humidity (V) | Memory evaluation at high-temperature, high-humidity | Memory evaluation at low-temperature, low humidity |
|---|---|---|---|---|---|---|
| Example 93 | 153 | 121 | 86 | 79 | ○ | ○ |
| Example 94 | 163 | 136 | 78 | 83 | ○ | ○ |
| Example 95 | 172 | 167 | 95 | 76 | ○ | ○ |
| Comp. Ex. 8 | 177 | 143 | 68 | 115 | Δ(positive) | X(negative) |
| Comp. Ex. 9 | 175 | 148 | 57 | 117 | Δ(positive) | X(negative) |

The results in the table showed that using the compound according to the present invention resulted in reduced environment dependence of potential and images, and revealed, in particular, that memory was significantly improved at low-temperature and low-humidity.

As all the above makes clear, the electrophotographic photoconductor of the present invention elicits a sufficient effect in various charging processes and development processes, or negative charging process and positive charging process of the photoconductor. As a result, it was confirmed that, by using a specific compound as an additive of an electrophotographic photoconductor, the present invention allows realizing an electrophotographic photoconductor in which electrical characteristics are stable initially, during repeated use, and upon changes in the usage environment conditions, and in which image defects such as image memory and the like do not occur, even under various conditions.

EXPLANATION OF REFERENCE NUMERALS

1 conductive substrate
2 undercoat layer
3 photosensitive layer
4 charge generation layer
5 charge transport layer
6 surface protective layer
21 roller charging member
22 high voltage power source
23 image exposure member
24 developing device
241 developing roller
25 paper feed member
251 paper feed roller
252 paper feed guide
26 transfer charger (direct charging type)
27 cleaning device
271 cleaning blade
28 charge-removing member
60 electrophotographic device
300 photosensitive layer

The invention claimed is:

1. An electrophotographic photoconductor having at least a photosensitive layer on a conductive substrate, wherein the photosensitive layer contains a diadamantyl diester compound represented by Formula (I) below (I)

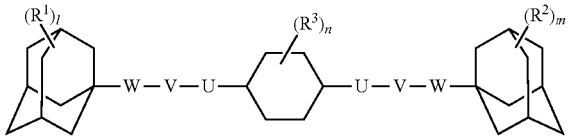

(in Formula (I), $R^1$, $R^2$ and $R^3$ each independently represent a hydrogen atom, a halogen atom, a substituted or unsubstituted C1-C6 alkyl group, a substituted or unsubstituted C1-C6 alkoxyl group, a C6-C20 aryl group or a heterocyclic group; l, m and n each represent an integer from 1 to 4; U and W represent a single bond or a substituted or unsubstituted C1-C6 alkylene group; and V represents an OCO group or a COO group).

2. An electrophotographic photoconductor having at least an undercoat layer on a conductive substrate, wherein the undercoat layer contains a diadamantyl diester compound represented by Formula (I) below (I)

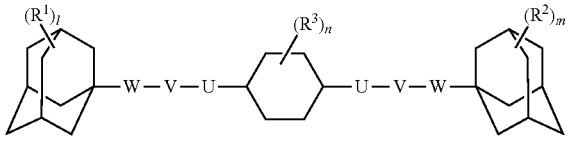

(in Formula (I), $R^1$, $R^2$ and $R^3$ each independently represent a hydrogen atom, a halogen atom, a substituted or unsubstituted C1-C6 alkyl group, a substituted or unsubstituted C1-C6 alkoxyl group, a C6-C20 aryl group or a heterocyclic group; l, m and n each represent an integer from 1 to 4; U and W represent a single bond or a substituted or unsubstituted C1-C6 alkylene group; and V represents an OCO group or a COO group).

3. An electrophotographic photoconductor having at least a charge generation layer on a conductive substrate, wherein the charge generation layer contains a diadamantyl diester compound represented by Formula (I) below (I)

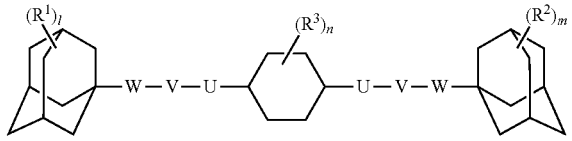

(in Formula (I), $R^1$, $R^2$ and $R^3$ each independently represent a hydrogen atom, a halogen atom, a substituted or unsubstituted C1-C6 alkyl group, a substituted or unsubstituted C1-C6 alkoxyl group, a C6-C20 aryl group or a heterocyclic group; l, m and n each represent an integer from 1 to 4; U and W represent a single bond or a substituted or unsubstituted C1-C6 alkylene group; and V represents an OCO group or a COO group).

4. An electrophotographic photoconductor having at least a charge transport layer on a conductive substrate, wherein the charge transport layer contains a diadamantyl diester compound represented by Formula (I) below (I)

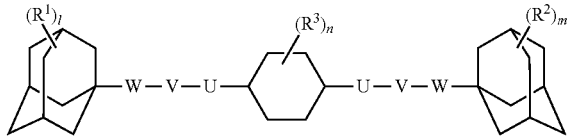

(in Formula (I), $R^1$, $R^2$ and $R^3$ each independently represent a hydrogen atom, a halogen atom, a substituted or unsubstituted C1-C6 alkyl group, a substituted or unsubstituted C1-C6 alkoxyl group, a C6-C20 aryl group or a heterocyclic group; l, m and n each represent an integer from 1 to 4; U and W represent a single bond or a substituted or unsubstituted C1-C6 alkylene group; and V represents an OCO group or a COO group).

5. An electrophotographic photoconductor having at least a surface protective layer on a conductive substrate, wherein the surface protective layer contains a diadamantyl diester compound represented by Formula (I) below (I)

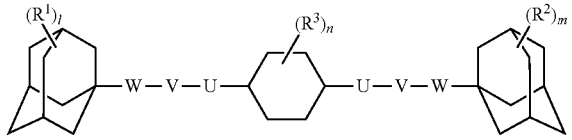

(in Formula (I), $R^1$, $R^2$ and $R^3$ each independently represent a hydrogen atom, a halogen atom, a substituted or unsubstituted C1-C6 alkyl group, a substituted or unsubstituted C1-C6 alkoxyl group, a C6-C20 aryl group or a heterocyclic group; l, m and n each represent an integer from 1 to 4; U and W represent a single bond or a substituted or unsubstituted C1-C6 alkylene group; and V represents an OCO group or a COO group).

6. The electrophotographic photoconductor according to claim 1, wherein the photosensitive layer is of positive charging single-layer type.

7. The electrophotographic photoconductor according to claim 1, wherein the photosensitive layer is of positive charging multilayer type.

8. The electrophotographic photoconductor according to any one of claims 1 to 5, wherein the diadamantyl diester compound has a structure represented by Formula (I-1) below (I-1)

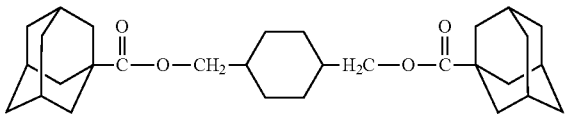

9. The electrophotographic photoconductor according to any one of claims 1 to 5, wherein an addition amount of the diadamantyl diester compound is 30 parts by mass or less with respect to 100 parts by mass of a resin binder that is comprised in the layer that contains the diadamantyl diester compound.

10. A method for producing an electrophotographic photoconductor, the method including a step of forming a layer by applying a coating solution onto a conductive substrate, wherein the coating solution contains a diadamantyl diester compound represented by Formula (I) below (I)

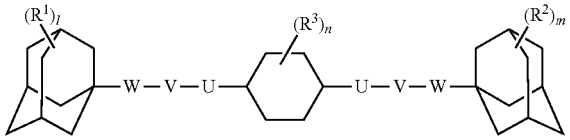

(in Formula (I), $R^1$, $R^2$ and $R^3$ each independently represent a hydrogen atom, a halogen atom, a substituted or unsubstituted C1-C6 alkyl group, a substituted or unsubstituted C1-C6 alkoxyl group, a C6-C20 aryl group or a heterocyclic group; l, m and n each represent an integer from 1 to 4; U and W represent a single bond or a substituted or unsubstituted C1-C6 alkylene group; and V represents an OCO group or a COO group).

* * * * *